US009458696B2

(12) United States Patent
Bisset et al.

(10) Patent No.: US 9,458,696 B2
(45) Date of Patent: Oct. 4, 2016

(54) VALVE ASSEMBLY

(71) Applicant: Managed Pressure Operations Pte. Ltd., Singapore (SG)

(72) Inventors: James Bisset, Dubai (AE); Rae Younger, Ellon (GB); Jonathan Buckland, Old Aberdeen (GB); Baptiste Gougeon, Scotland Aberdeen (GB); Stuart Rothnie, Inverurie (GB); Christian Leuchtenberg, Singapore (SG)

(73) Assignee: MANAGED PRESSURE OPERATIONS PTE. LTD., Singapore (SG)

( * ) Notice: Subject to any disclaimer, the term of this patent is extended or adjusted under 35 U.S.C. 154(b) by 383 days.

(21) Appl. No.: 14/178,509

(22) Filed: Feb. 12, 2014

(65) Prior Publication Data

US 2014/0158433 A1 Jun. 12, 2014

Related U.S. Application Data

(63) Continuation of application No. 13/997,020, filed as application No. PCT/GB2011/052579 on Dec. 23, 2011, now abandoned.

(30) Foreign Application Priority Data

Dec. 24, 2010 (GB) ..... 1022004.4

(51) Int. Cl.
*E21B 17/18* (2006.01)
*E21B 34/14* (2006.01)
(Continued)

(52) U.S. Cl.
CPC ..... *E21B 34/08* (2013.01); *E21B 21/103* (2013.01); *E21B 2034/002* (2013.01)

(58) Field of Classification Search
CPC ..... E21B 17/18; E21B 34/10; E21B 34/12; E21B 34/14; F16K 5/06; F16K 5/10; F16K 31/122; F16K 31/1221
USPC ..... 166/332.3, 334.4, 320, 332.7, 324; 251/304, 315.01, 315.08, 315.16; 175/241, 242, 243
See application file for complete search history.

(56) References Cited

U.S. PATENT DOCUMENTS 704,423 A 7/1902 Allen
1,491,986 A 4/1924 Greene
(Continued)

FOREIGN PATENT DOCUMENTS

EP 1248065 A2 10/2002
EP 1048819 B1 2/2004
(Continued)

OTHER PUBLICATIONS

Examination Report for GB1310776.8 dated Jan. 30, 2015, 2 pgs., Applicant: Managed Pressure Operations Pte. Ltd.
(Continued)

*Primary Examiner* — Kenneth L Thompson
(74) *Attorney, Agent, or Firm* — Norman B. Thot

(57) ABSTRACT

A valve assembly comprising a body having a main passage, and a valve member which is located in the main passage and which is rotatable between an open position in which the main passage is substantially open, and a closed position in which the valve member substantially blocks the main passage, and an actuator which is movable generally parallel to the longitudinal axis of the main passage, the actuator being engaged with the valve member such that movement of the actuator generally parallel to the longitudinal axis of the main passage causes the valve member to rotate between its open and closed positions.

20 Claims, 14 Drawing Sheets

(51) Int. Cl.

| | |
|---|---|
| ***F16K 5/10*** | (2006.01) |
| ***F16K 31/122*** | (2006.01) |
| ***E21B 34/10*** | (2006.01) |
| ***E21B 34/08*** | (2006.01) |
| ***E21B 21/10*** | (2006.01) |
| *E21B 34/00* | (2006.01) |

(56) References Cited

U.S. PATENT DOCUMENTS

| | | | | |
|---|---|---|---|---|
| 2,102,555 | A | 12/1937 | Dyer | |
| 2,158,356 | A | 5/1939 | Dyer | |
| 2,894,715 | A * | 7/1959 | Bostock | E21B 34/10 166/324 |
| 3,007,669 | A * | 11/1961 | Fredd | E21B 34/10 137/505.47 |
| 3,236,255 | A | 2/1966 | Sizer | |
| 3,398,762 | A * | 8/1968 | Fredd | E21B 34/10 137/495 |
| 3,470,971 | A | 10/1969 | Dower | |
| 3,703,193 | A | 11/1972 | Raulins | |
| 3,762,219 | A | 10/1973 | Jessup | |
| 3,871,447 | A | 3/1975 | Crowe | |
| 4,210,207 | A * | 7/1980 | McStravick | E21B 34/12 166/330 |
| 4,448,267 | A | 5/1984 | Crawford, III et al. | |
| 4,535,968 | A * | 8/1985 | Gano | E21B 34/02 166/330 |
| 4,560,004 | A * | 12/1985 | Winslow | E21B 34/12 166/321 |
| 4,685,520 | A | 8/1987 | McDaniel | |
| 4,714,116 | A * | 12/1987 | Brunner | E21B 23/006 166/321 |
| 4,770,389 | A | 9/1988 | Bodine et al. | |
| 4,823,877 | A | 4/1989 | McDaniel et al. | |
| 4,867,254 | A | 9/1989 | Gavignet | |
| 4,901,761 | A | 2/1990 | Taylor | |
| 5,070,949 | A | 12/1991 | Gavignet | |
| 5,080,182 | A | 1/1992 | Thompson | |
| 5,115,871 | A | 5/1992 | McCann et al. | |
| 5,222,425 | A | 6/1993 | Davies | |
| 5,341,883 | A * | 8/1994 | Ringgenberg | E21B 34/103 166/324 |
| 5,431,188 | A | 7/1995 | Cove | |
| 5,529,126 | A * | 6/1996 | Edwards | E21B 34/108 166/240 |
| 5,613,561 | A | 3/1997 | Moriarty | |
| 5,628,493 | A | 5/1997 | McKnight et al. | |
| 5,782,304 | A * | 7/1998 | Garcia-Soule | E21B 23/006 166/320 |
| 5,975,219 | A | 11/1999 | Sprehe | |
| 6,244,631 | B1 | 6/2001 | Payne et al. | |
| 6,315,051 | B1 | 11/2001 | Ayling | |
| 6,739,397 | B2 | 5/2004 | Ayling | |
| 7,028,586 | B2 | 4/2006 | Robichaux | |
| 7,107,875 | B2 | 9/2006 | Haugen et al. | |
| 7,308,952 | B2 | 12/2007 | Strazhgorodskiy | |
| 7,836,973 | B2 | 11/2010 | Belcher et al. | |
| 8,844,653 | B2 * | 9/2014 | deBoer | E21B 17/00 166/334.4 |
| 2005/0092523 | A1 | 5/2005 | McCaskill et al. | |
| 2006/0060360 | A1 | 3/2006 | Moncus et al. | |
| 2006/0254822 | A1 | 11/2006 | Ayling | |
| 2006/0278434 | A1 | 12/2006 | Calderoni et al. | |
| 2009/0025930 | A1 | 1/2009 | Iblings et al. | |
| 2010/0155143 | A1 | 6/2010 | Braddick | |
| 2010/0200299 | A1 | 8/2010 | Vatne | |
| 2010/0252272 | A1 | 10/2010 | Haughom | |
| 2010/0300543 | A1 | 12/2010 | Braddick | |

FOREIGN PATENT DOCUMENTS

| | | | |
|---|---|---|---|
| EP | 1754947 | A2 | 2/2007 |
| EP | 2660421 | A2 | 11/2013 |
| GB | 702085 | | 1/1954 |
| GB | 1416085 | A | 12/1975 |
| GB | 2119046 | A | 11/1983 |
| GB | 2290330 | A | 12/1995 |
| GB | 2314106 | A | 12/1997 |
| GB | 2413373 | A | 10/2005 |
| GB | 2427216 | A | 12/2006 |
| GB | 2427217 | B | 10/2008 |
| GB | 2451699 | A | 2/2009 |
| WO | 0236928 | A1 | 5/2002 |
| WO | 2004074627 | A1 | 9/2004 |
| WO | 2005019596 | A1 | 3/2005 |
| WO | 2005080745 | A1 | 9/2005 |
| WO | 2007005822 | A2 | 1/2007 |
| WO | 2007124330 | A2 | 11/2007 |
| WO | 2008051978 | A1 | 5/2008 |
| WO | 2008095650 | A1 | 8/2008 |
| WO | 2008156376 | A1 | 12/2008 |
| WO | 2009018173 | A2 | 2/2009 |
| WO | 2009022914 | A1 | 2/2009 |
| WO | 2010046653 | A2 | 4/2010 |
| WO | 2011159983 | A1 | 12/2011 |
| WO | 2012085597 | A2 | 6/2012 |

OTHER PUBLICATIONS

M. Hutchinson et al., "Using Downhole Annular Pressure Measurements to Anticipate Drilling Problems" Society of Petroleum Engineers, SPE 49114, SPE Annual Technical Conference and Exhibition, New Orleans, Sep. 27-30, 1998, pp. 535-549.

J.A. Schubert et al., "Early Kick Detection Through Liquid Level Monitoring in the Wellbore" Society of Petroleum Engineers, IADC/SPE 39400, IADC/SPE Drilling Conference, Dallas, TX, Mar. 3-6, 1998, pp. 889-895.

Pal Skalle, "Trends Extracted from 800 Gulf Coast Blowouts During 1960-1996" Society of Petroleum Engineers, IADC/SPE 39354, IADC/SPE Conference, Dallas, TX, Mar. 3-6, 1998, pp. 539-546.

International Search Report issued in related GB Patent Application No. GB 0905802.5, dated Jul. 31, 2009, 2 pages.

International Search Report issued in related GB Patent Application No. GB 0905633.4, dated Aug. 10, 2009, 1 page.

International Search Report issued in related PCT Patent Application No. PCT/EP2010/054387, dated Oct. 10, 2010, 2 pages.

International Search Report issued in related PCT Patent Application No. PCT/EP2010/063579, dated Nov. 3, 2010, 3 pages.

International Search Report issued in related PCT Patent Application No. PCT/GB2010/050571, dated Dec. 29, 2010, 3 pages.

International Search Report with Written Opinion issued in International Patent Application No. PCT/GB2011/052579; dated Apr. 17, 2013; 11 pages.

Examination Report for GB1310776.8, dated Apr. 28, 2015, 2 pages.

* cited by examiner

VALVE ASSEMBLY

CROSS REFERENCE TO RELATED APPLICATION

This application is a continuation of and claims priority to and the benefit of U.S. patent application Ser. No. 13/997,020, titled "Valve Assembly," filed Jun. 21, 2013, which is a national phase application of International Application No. PCT/GB2011/052579 titled "Valve Assembly", filed Dec. 23, 2011, which claims priority to GB Application No 1022004.4 titled "Drill Pipe", filed Dec. 24, 2010, the full disclosure of each which is hereby incorporated herein by reference in its entirety for all purposes.

SUMMARY OF THE INVENTION

The present invention relates to a valve assembly, in particular for use in a drill pipe during drilling of a well bore.

The drilling of a borehole or well is typically carried out using a steel pipe known as a drill pipe or drill string with a drill bit on the lowermost end. The drill string comprises a series of tubular sections, which are connected end to end.

The entire drill string may be rotated using a rotary table, or using an over-ground drilling motor mounted on top of the drill pipe, typically known as a 'top-drive', or the drill bit may be rotated independently of the drill string using a fluid powered motor or motors mounted in the drill string just above the drill bit. As drilling progresses, a flow of mud is used to carry the debris created by the drilling process out of the borehole. Mud is pumped down the drill string to pass through the drill bit, and returns to the surface via the annular space between the outer diameter of the drill string and the borehole (generally referred to as the annulus). The mud flow also serves to cool the drill bit, and to pressurise the borehole, thus substantially preventing inflow of fluids from formations penetrated by the drill string from entering into the borehole. Mud is a very broad drilling term and in this context it is used to describe any fluid or fluid mixture used during drilling and covers a broad spectrum from air, nitrogen, misted fluids in air or nitrogen, foamed fluids with air or nitrogen, aerated or nitrified fluids to heavily weighted mixtures of oil and or water with solid particles.

Significant pressure is required to drive the mud along this flow path, and to achieve this, the mud is typically pumped into the drill string using one or more positive displacement pumps which are connected to the top of the drill string via a pipe and manifold.

Whilst the main mud flow into the well bore is achieved by pumping mud into a main, axial, passage at the very top end of the drill string, it is also known to provide the drill string with a side passage which extends into the main passage from a port provided in the side of the drill string, so that mud can be pumped into the main passage at an alternative location to the top of the drill string.

For example, as drilling progresses, and the bore hole becomes deeper and deeper, it is necessary to increase the length of the drill string, and this is typically achieved by disengaging the top drive from the top of the drill string, adding a new section of tubing to the drill string, engaging the top drive with the free end of the new tubing section, and then recommencing drilling. It will, therefore, be appreciated that pumping of mud down the drill string ceases during this process.

Stopping mud flow in the middle of the drilling process is problematic for a number of reasons, and it has been proposed to facilitate continuous pumping of mud through the drill string by the provision of a side passage, typically in each section of drill string. This means that mud can be pumped into the drill string via the side passage whilst the top of the drill string is closed, the top drive disconnected and the new section of drill string being connected.

In one such system, disclosed in U.S. Pat. No. 2,158,356, at the top of each section of drill string, there is provided a side passage which is closed using a plug, and a valve member which is pivotable between a first position in which the side passage is closed whilst the main passage of the drill string is open, and a second position in which the side passage is open whilst the main passage is closed. During drilling, the valve is retained in the first position, but when it is time to increase the length of the drill string, the plug is removed from the side passage, and a hose, which extends from the pump, connected to the side passage, and a valve in the hose opened so that pumping of mud into the drill string via the side passage commences. A valve in the main hose from the pump to the top of the drill string is then closed, and the pressure of the mud at the side passage causes the valve member to move from the first position to the second position, and hence to close the main passage of the drill string.

The main hose is then disconnected, the new section of tubing mounted on the drill string, and the main hose connected to the top of the new section. The valve in the main hose is opened so that pumping of mud into the top of the drill string is recommenced, and the valve in the hose to the side passage closed. The resulting pressure of mud entering the top of the drill string causes the valve member to return to its first position, which allows the hose to be removed from the side passage, without substantial leakage of mud from the drill string.

The side passage may then be sealed permanently, for example by welding or screwing a plug into the side passage, before this section of drill string is lowered into the well.

This process is commonly referred to as continuous circulation drilling.

In other similar systems, instead of providing a single valve member which is operable to close either the side passage or the main passage of the drill string, it is known to provide two separate valve members each with its own actuation mechanism—a main valve member which is operable to close the main passage, and an auxiliary valve member which is operable to close the side passage.

The drill string may also be provided with a side passage in what is known as a "pump in sub", which is used in the event of an emergency, for example to facilitate the provision of additional mud pressure required to control a sudden surge in well-bore pressure due to fluid inflow from a formation penetrated by the well entering the well in what is known as a "kick".

This invention relates to an alternative valve arrangement for continuous circulation drilling.

According to the invention we provide a valve assembly comprising a body having a main passage, and a valve member which is located in the main passage and which is rotatable between an open position in which the main passage is substantially open, and a closed position in which the valve member substantially blocks the main passage, and an actuator which is movable generally parallel to the longitudinal axis of the main passage, the actuator being engaged with the valve member such that movement of the actuator generally parallel to the longitudinal axis of the main passage causes the valve member to rotate between its open and closed positions.

In an embodiment of the invention, the body is further provided with a side passage, the side passage extending from the main passage to the exterior of the body. In this case, the side passage may extend generally at right angles to the longitudinal axis of the main passage.

The body may be a drill pipe or pump in sub for connection to a drill pipe.

In one embodiment of the invention, the actuator is movable, generally parallel to the longitudinal axis of the passage, between an open position in which the side port is open, and a closed position in which the actuator substantially closes the side port. In this case, the valve assembly may be configured such that when the actuator is in the open position, the valve member is in the closed position, and when the actuator is in the closed position, the valve member is in the open position.

In one embodiment of the invention the actuator is located within the main passage.

The actuator may comprises a generally cylindrical sleeve.

The valve member may be provided with a central passage which extends right through the valve member, the central passage having a longitudinal axis which extends generally perpendicular to the axis of rotation of the valve member. In this case, the valve assembly may be arranged such that when the valve member is in the open position, the central passage lies generally parallel to the main passage so that fluid flowing along the main passage of the valve assembly travels via the central passage in the valve member, and when the valve member is in the closed position, the central passage lies generally perpendicular to the main passage.

The valve member and actuator may be engaged such that movement of the actuator generally parallel to the longitudinal axis of the main passage in a first direction causes the valve member to rotate through a first angle in a first rotational sense and subsequent movement of the actuator generally parallel to the longitudinal axis of the main passage in a second, opposite, direction causes the valve member to rotate through a second angle in the first rotational sense, the sum of the first and second angles being about 90°. In this case, the first and second angles may be about 45°.

The valve member may be provided with a generally circular and planar index surface which extends generally parallel to the longitudinal axis of the central passage. In this case, the index surface may be provided with a track and the actuator sleeve is provided with a corresponding coupling formation which engages with the track to guide movement of the ball relative to the actuator in a predetermined manner. The track may be shaped such that, by engagement of the coupling formation with the track, sliding movement of the actuator relative to the body causes the ball to rotate. The track may comprise a groove in the index surface.

The coupling formation may comprise a pin mounted on an arm which extends between the index surface and the body from an end of the actuator adjacent the valve member, the pin extending from the arm towards the index surface.

The track may form a continuous loop around the index surface. In this case, the track may comprise four substantially identical portions each of which extends from an edge of the index surface towards the centre of the index surface and then back towards the edge of the index surface.

The body may be provided with an actuator conduit and the actuator configured such that the movement of the actuator generally parallel to the longitudinal axis of the main passage in one direction is achieved by the supply of pressurised fluid to the actuator conduit.

Further more, the body may be provided with a further actuator conduit and the actuator configured such that the movement of the actuator generally parallel to the longitudinal axis of the main passage in an opposite direction is achieved by the supply of pressurised fluid to the further actuator conduit.

The valve assembly may further comprise a return spring which urges the actuator to move generally parallel to the longitudinal axis of the main passage in the opposite direction.

The valve assembly may comprise an actuation chamber between the actuator and the body of the valve assembly, the chamber being divided into two by a seal which extends between the body of the valve assembly and the actuator to substantially prevent flow of fluid between the two parts of the actuation chamber, and two ports are provided through the body, the first port extending from the exterior of the body into the first part of the actuation chamber, and the second port extending from the exterior of the body into the second part of the actuation chamber.

DESCRIPTION OF THE DRAWINGS

Various embodiments of the invention are described below, by way of example only, with reference to the accompanying drawings, of which.

DETAILED DESCRIPTION OF THE INVENTION

Figure 1A:
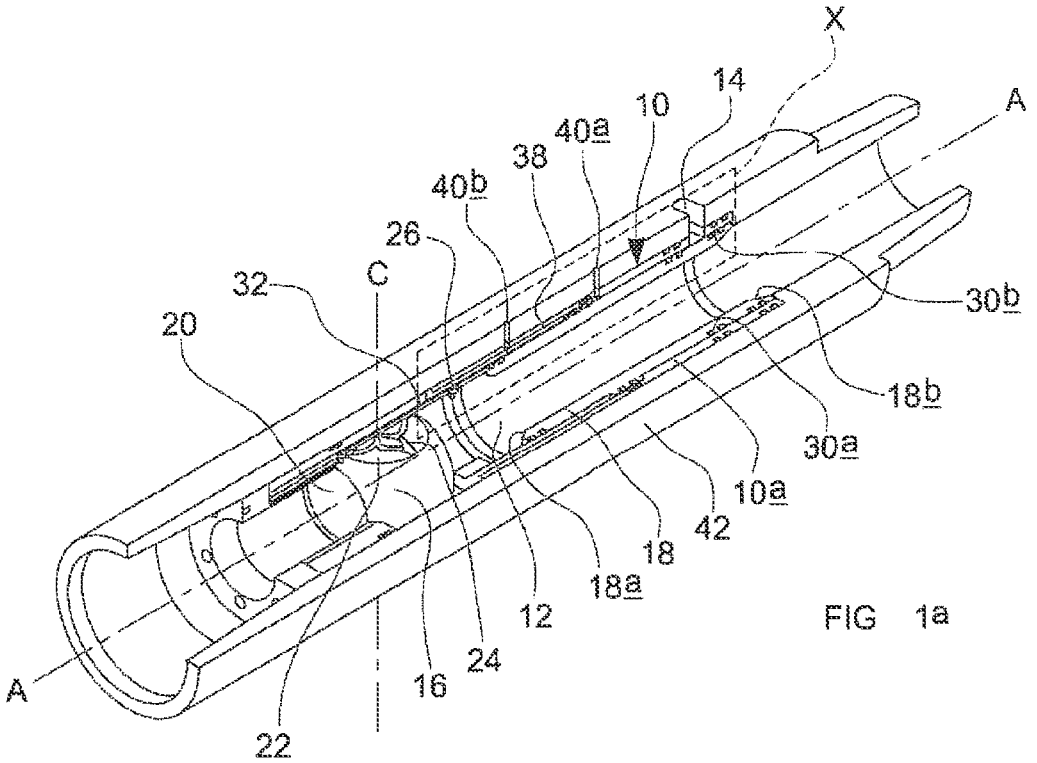
FIG. 1 is a cutaway perspective view of a valve assembly according to the invention with a) the main valve member in its fully open position and the actuator sleeve in its equilibrium position, b) the main valve member in a partially open position and the actuator sleeve in its third position, c) the main valve member in its fully closed position and the actuator sleeve in its second position, d) the main valve member in a partially open position and the actuator sleeve in its third position, e) the main valve member in its fully open position and the actuator sleeve in its equilibrium position.

Referring now to the figures, there is provided a valve assembly 10 having a body 10*a* in which is formed a main passage 12 and a side passage 14, the side passage 14 extending from the main passage 12 to the exterior of the body 10*a*, in this example, generally at right angles to a longitudinal axis A of the main passage 12. The main passage 12 has a generally circular transverse cross-section, whilst the side passage 14 has an oval shaped transverse cross-section, the major axis of the oval lying perpendicular to the longitudinal axis A.

The valve assembly 10 is further provided with a main valve member 16 which is rotatable between an open position in which flow of fluid along the main passage 12 is permitted and a closed position in which the main valve member 16 substantially prevents flow of fluid along the main passage 12. Movement of the main valve member 16 between the open and closed positions is achieved by sliding an actuator sleeve 18 relative to the body 10*a* of the valve assembly 10 generally parallel to the longitudinal axis A.

In this preferred embodiment of the invention the actuator sleeve 18 also forms a second, auxiliary valve member, which is slidable between an open position in which flow of fluid through the side passage 14 is permitted, and a closed position in which it substantially prevents flow of fluid through the side passage 14.

In this example, the main valve member 16 is a ball valve and so has a part spherical body which is shaped to have a central passage 20 which extends diametrically across the generally spherical body and two diametrically opposed circular planar surfaces (hereinafter referred to as index surfaces 22). Both the index surfaces 22 are parallel to one another and to a longitudinal axis B of the central passage 20. The ball 16 is mounted within the main passage 12 and is rotatable about axis C which is perpendicular to the longitudinal axis A of the main passage 12 and to the index surfaces 22. When the main valve member 16 is in a fully open position (illustrated in FIGS. 1*a*, 1*e*, 2*a*, and 2*e*), the central passage 20 in the ball lies generally parallel to the main passage 12, so that fluid flowing along the main passage 12 of the valve assembly 10 travels via the central passage 20 in the ball 16. When the main valve member 16 is in a fully closed position (illustrated in FIGS. 1*c* and 2*c*), the central passage 20 lies generally perpendicular to the main passage 12, and so the ball 16 blocks flow of fluid along the main passage 12 in the valve assembly 10. Standard Kelly valve seals are provided between the ball 16 and the valve assembly body 10*a* to ensure that fluid cannot flow along the main passage 12 around the ball 16.

Each index surface 22 is provided with a track 24, which, in this example, is a specially shaped groove in the index surface 22. The actuator sleeve 18 is provided with a corresponding coupling formation (hereinafter referred to as index pin 26) which engages with the track 24 to guide movement of the ball 16 relative to the actuator sleeve 18 in a predetermined manner. The track 24 is shaped so that, when the index pin 26 is located in the track 24, sliding movement of the actuator sleeve 18 relative to the valve assembly body 10*a* causes the ball 16 to rotate about its axis C.

Figure 4:
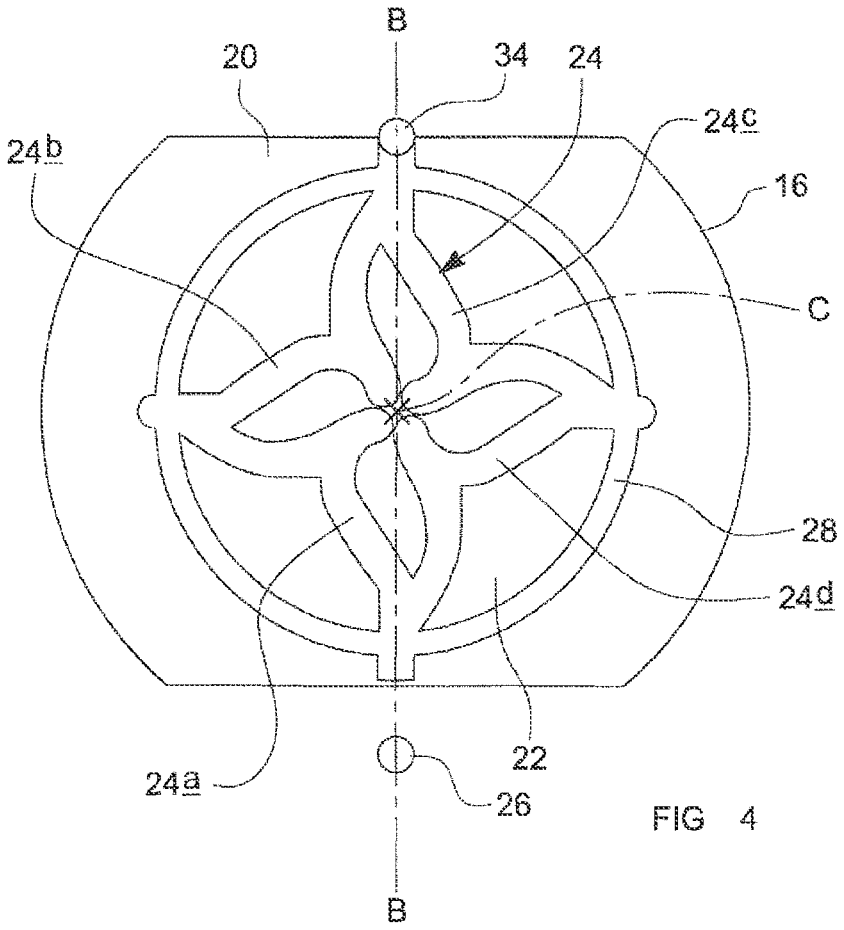
FIG. 4 is a top view of the main valve member, index pin and locking pin when the actuator sleeve is in its equilibrium position.

In this embodiment of the invention, the track 24 has four identical portions 24*a*, 24*b*, 24*c*, 24*d*. The track 24 is best illustrated in FIG. 4, in which it can be seen that each of the portions 24*a*, 24*b*, 24*c*, 24*d* has a first part which extends radially inwardly toward the centre of the index surface 22 before turning away from the centre of the index surface 22, in this example to the left when the track 24 is viewed from above the ball 16 and through about 45°, into a second part which continues in this direction before reaching a third part. The third part curves back towards the centre of the index surface 22 to extend almost to the centre of the index surface 22 along a radius of the index surface 22 which subtends an angle of 45° to the radius on which the first part lay. The first part of each portion 24*a*, 24*b*, 24*c*, 24*d* starts at an edge of the index surface 22 (the edge being the line of intersection between the index surface 22 and the spherical surface of the ball 16).

Each of the portions 24*a*, 24*b*, 24*c*, 24*d* also has a fourth part which extends from the third part to back to the edge of the index surface 22 at the radius of the index surface 22 which subtends an angle of 90° to the radius on which the first part lay. The fourth part of the first portion 24*a* is joined to the first part of the second portion 24*b*, the fourth part of the second portion 24*b* is joined to the first part of the third portion 24*c*, fourth part of the third portion 24*c* is joined to the first part of the fourth portion 24*d*, and the fourth part of the fourth portion 24*d* is joined to the first part of the first portion 24*a*. The four portions of track 24*a*, 24*b*, 24*c*, 24*d* thus form a continuous, if rather convoluted, loop around the index surface 22.

The first part of the first and third portions 24*a*, 24*c* extends through the spherical surface of the ball 16 so that a pin in the first part of the first and third portions 24*a*, 24*c* of the track 24 can be removed from the track 24 by a relative sliding movement without the need to move the pin perpendicular to the index surface 22. In contrast, the first parts of the second and fourth portions 24*c*, 24*d* do not extend through the spherical surface of the ball 16. This means that it is necessary to lift a pin to remove it from the first parts of the second and fourth portions 24*b*, 24*d*. In other words, the end of the first part of the first and third portions 24*a* is open whilst the ends of the first parts of the second and fourth portions 24*c*, 24*d* are closed.

The first part of the first portion 24*a* and the first part of the third portion 24*c* of the track are both located on a plane which includes the longitudinal axis B of the central passage 20 in the ball 16 and the axis of rotation C as best illustrated in FIG. 4.

Although not essential, in this example, each index surface 22 also has a pivot support formation 28 which engages with a corresponding formation on the interior surface of the valve assembly body 10*a* to provide a pivot for rotation of the ball 16 about its axis C. In this example, the pivot support formation 28 is a groove which extends around a circle spaced from but close to the edge of the index surface 22. As this groove intersects the track 24 in four places, it is divided into four portions. Two corresponding circular pivot support ridges are provided, each on diametrically opposite parts of the interior surface of the valve assembly body 10*a*. For reasons which will become apparent below, each pivot support ridge is divided into two halves, with a gap between the ends of each half. In use, the pivot support ridges are located in the groove 28 provided in each index surface 22 and provide a bearing for rotation of the ball 16 about its axis C.

The actuator sleeve 18 is generally cylindrical and is located in the main passage 12 of the valve assembly so that its longitudinal axis is generally coincident with the longitudinal axis A of the main passage 12. Its outer diameter is slightly smaller than the diameter of the main passage 12 and two seals 30*a*, 30*b* are provided between the actuator sleeve 18 and the body 10*a* of the valve assembly 10. The side passage 14 is located between the two seals 30*a*, 30*b*. The seals 30*a*, 30*b* could be any type of seal capable of providing a substantially fluid tight seal so as to prevent fluid from flowing along the main passage 12 of the valve assembly between actuator sleeve 18 and the valve assembly body 10*a* whilst allowing sliding movement along axis A of the actuator sleeve 18 relative to the valve assembly body 10*a*. In this example two sealing members are provided at each seal 30*a*, 30*b* and each sealing member is an elastomeric O-ring which is located in a circumferential groove around the exterior surface of the actuator sleeve 18*a*. It should be appreciated that more seals or many different types of seal could be used instead—including metal-to-metal, Chevron or Z seals.

The end 18*a* of the actuator sleeve 18 adjacent to the main valve member 16 (the first end 18*a*), is provided with two diametrically opposite actuator arms 32 each of which extends from the first end 18*a* of the actuator sleeve 18 in a direction generally parallel to the longitudinal axis A. An index pin 26 is positioned around half way along each of the actuator arms 32, the index pin 26 extending radially inwardly of the actuator arm 32 towards the opposite index pin 26. A locking pin 34 is also provided at the end of each actuator arm 32, also extending radially inwardly towards the opposite locking pin 26.

The actuator arms 32 extend between the two halves of each pivot support ridge. The spacing of the actuator arms 32 is such that there is room for the ball 16 to fit between them with the two index surfaces 22 each adjacent one of the actuator arms 32, and either the locking pin 34 or the index pin 26 on each arm 32 extending into the track 24.

A return spring (not shown for clarity) is provided between the actuator sleeve 18 and the body 10*a* of the valve assembly 10, the return spring being adapted to urge the actuator sleeve 18 back to an equilibrium position when the spacing between the actuator sleeve 18 and the ball 16 is less than when the actuator sleeve 18 is in its equilibrium position. In this example, the return spring 36 is a helical compression spring which may be located between a shoulder provided on the internal surface of the body 10*a* of the valve assembly 10, and the first end 18*a* of the actuator sleeve or the ends of the actuator arms 32. When the actuator sleeve 18 is in its equilibrium position (illustrated in FIGS. 1*a*, 1*e*, 2*a*, 2*e*, and 3), the side passage 14 is covered by the actuator sleeve 18, the two seals 30*a*, 30*b* ensuring that flow of fluid into the main passage 12 via the side passage 14 is substantially prevented. Also when the actuator sleeve 18 is in its equilibrium position the locking pins 34 are located in the first part of the third portion 24*c* of the track 24, the engagement of the lock pins 34 with the track preventing rotation of the ball 16 about its axis C, and the index pins 26 are not engaged with the track 24 (as illustrated in FIG. 4).

Figure 3:
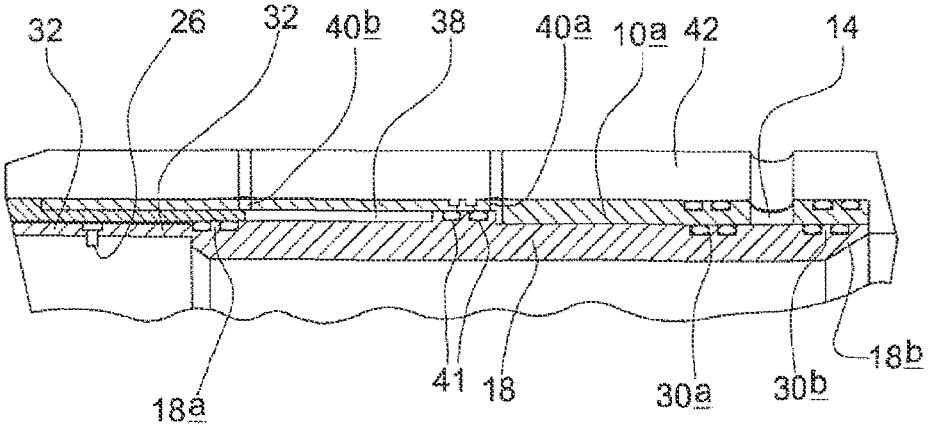
FIG. 3 is a cross-sectional view through the portion of the valve assembly marked X in FIG. 1*a*.

The actuator sleeve 18 is hydraulically actuated by mean of an actuation chamber 38 which is provided between the actuator sleeve 18 and the body 10*a* of the valve assembly 10. This is best illustrated in FIG. 3 and simply comprises an annular space between the two parts 18, 10*a*. Two ports 40*a*, 40*b* are provided through the body 10*a* into this chamber 38, one at each end of the chamber 38. The first port 40*a* is closest to the second end 18*b* of the actuator sleeve 18. The chamber 38 is divided into two by a seal 41 which is mounted on the exterior surface of the actuator sleeve 18. In this example, the seal 41 comprises 2 O-rings. The seal 41 substantially prevents flow of fluid between the two parts of the chamber 38 whilst permitting the actuator sleeve 18 to slide inside the valve assembly body 10*a*. The seal 41 ensures that flow of pressurised fluid into this chamber 38 via the first port 40*a* causes the actuator sleeve 18 to move towards the ball 16, providing the pressure in the chamber 38 is sufficient to overcome the biasing force of the return spring 36. Flow of pressurised fluid into the actuation chamber 38 via the second port 40*b* acts in the opposite direction to counterbalance the effect of pressurised fluid at the first port 40*a*. The actuator sleeve 18 therefore acts as a double acting piston with one pressure port 40*a* to move the sleeve 18 towards the ball 16 and one pressure port to move the sleeve 18 away from the ball 16.

The main valve 16 is operated as follows.

Figure 5A:
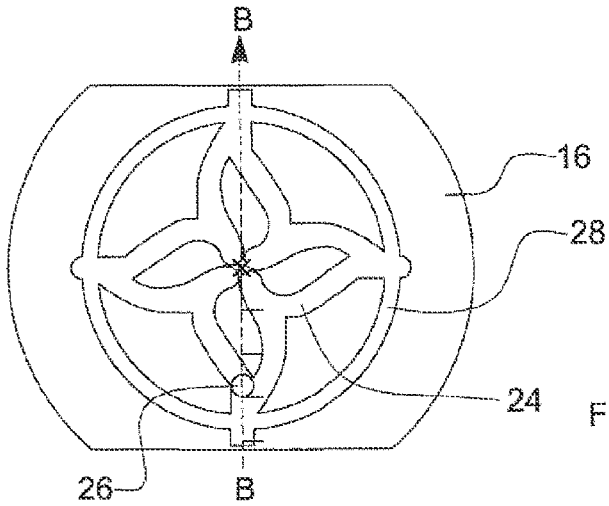
FIG. 5 is a top view of the main valve member and index pin with a) the index pin in the first part of the first portion of the track, b) the index pin in the second part of the first portion of the track, c) the index pin further along the second part of the first portion of the track, d) the index pin at the end of the second part of the first portion of the track, e) the index pin entering the third part of the first portion of the track, f) the index pin at the end of the third part of the first portion of the track, g) the index pin in the fourth part of the first portion of the track, h) the index pin at the end of the fourth part of the first portion of the track, i) the index pin in the first part of the second portion of the track, with line Z showing the direction of travel of the index pin.
Figure 5B:
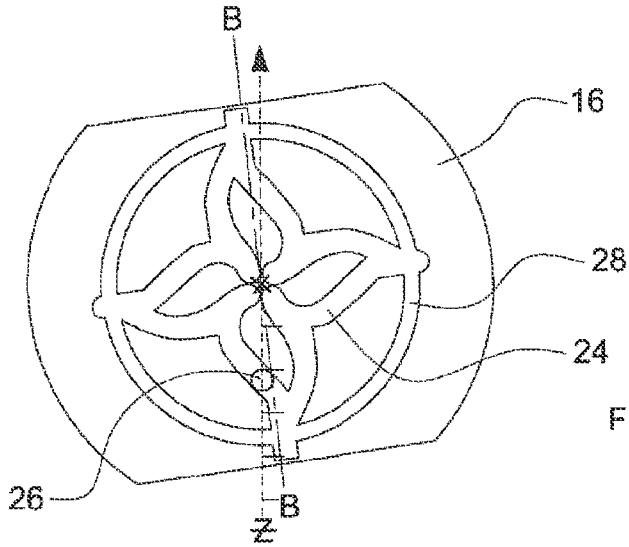
Figure 5C:
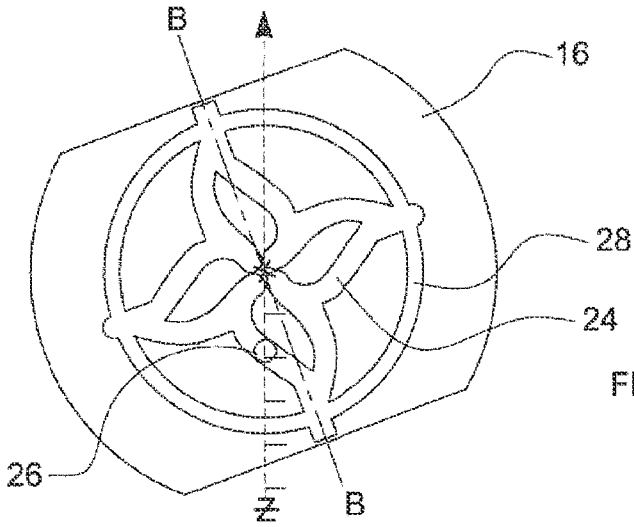

Actuation of the ball valve 16 is achieved by supplying pressurised fluid to the first actuation port 40*a*. The pressurised fluid is preferably hydraulic fluid but could be any sort of fluid including compressed air, water or drilling mud. This pushes the actuator sleeve 18 against the biasing force of the return spring 36 from its equilibrium position towards the ball 16 so that the locking pins 34 are no longer engaged with the ball 16 and the index pins 26 enter into the first part of the first portion 24*a* of the track 24. The actuator sleeve 18 is then in its second position, illustrated in FIG. 5*a*. When the actuator sleeve 18 is in its equilibrium and second positions, the ball valve 16 lies in its fully open position, i.e. orientated with the longitudinal axis B of the central passage 20 generally parallel to the longitudinal axis A of the main passage 12. The interaction of the index pins 26 with the track 24 means that further sliding movement of the actuator sleeve 18 towards the ball 16 causes the ball 16 to rotate as the index pins 26 enter the second part of the first portion 24*a* of each track 24 (as illustrated in FIGS. 5*b* & 5*c*).

Figure 1B:
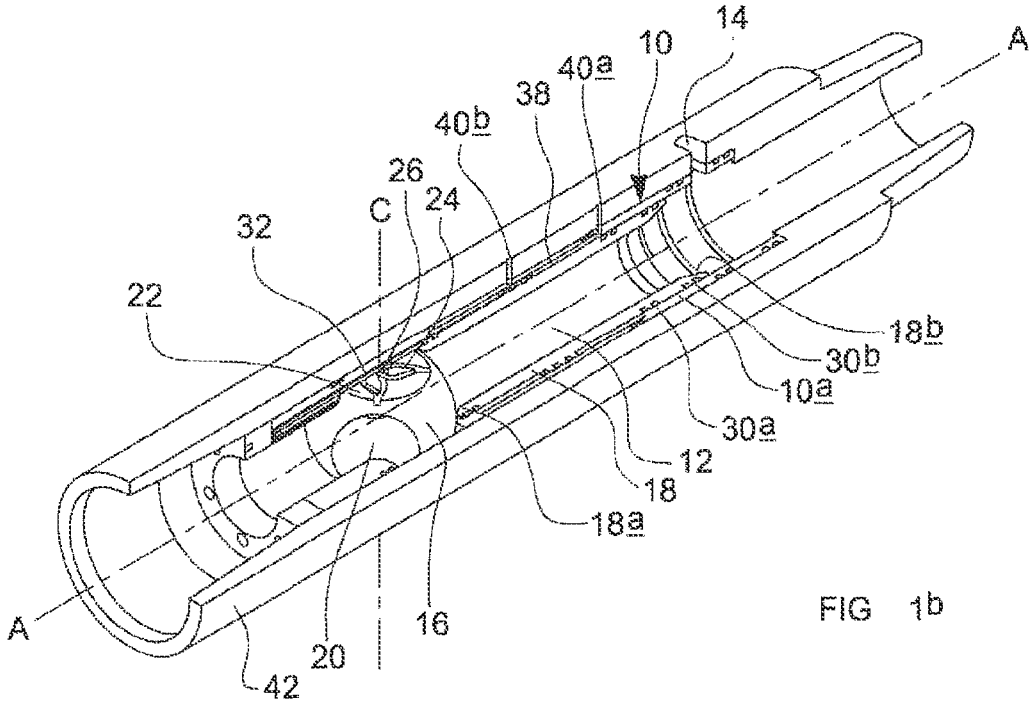
Figure 1C:
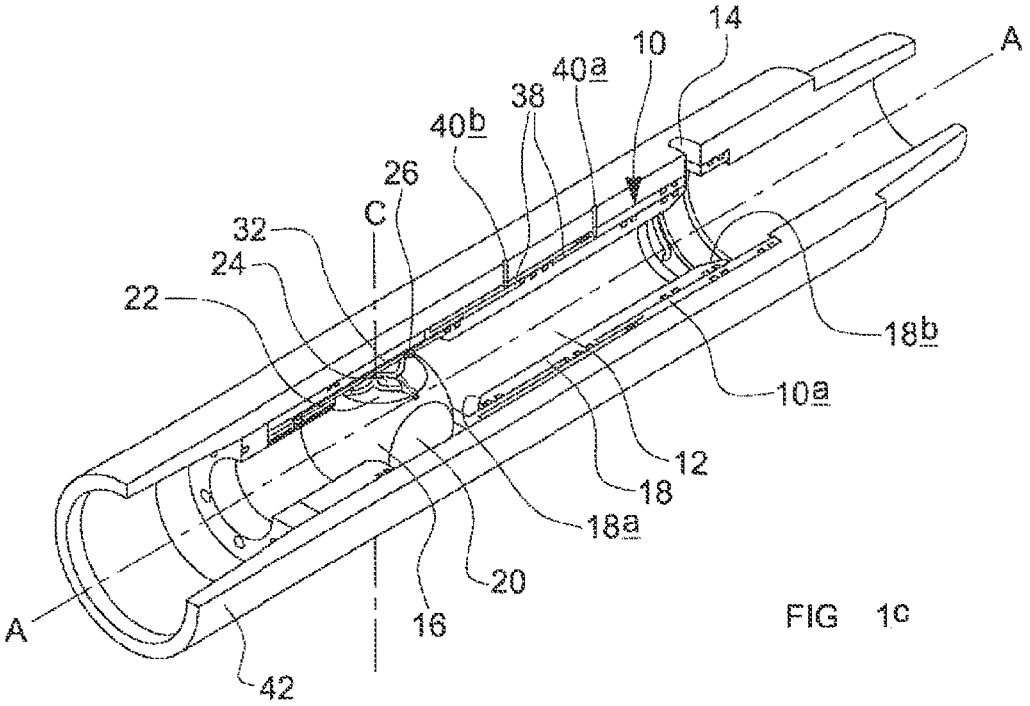
Figure 2A:
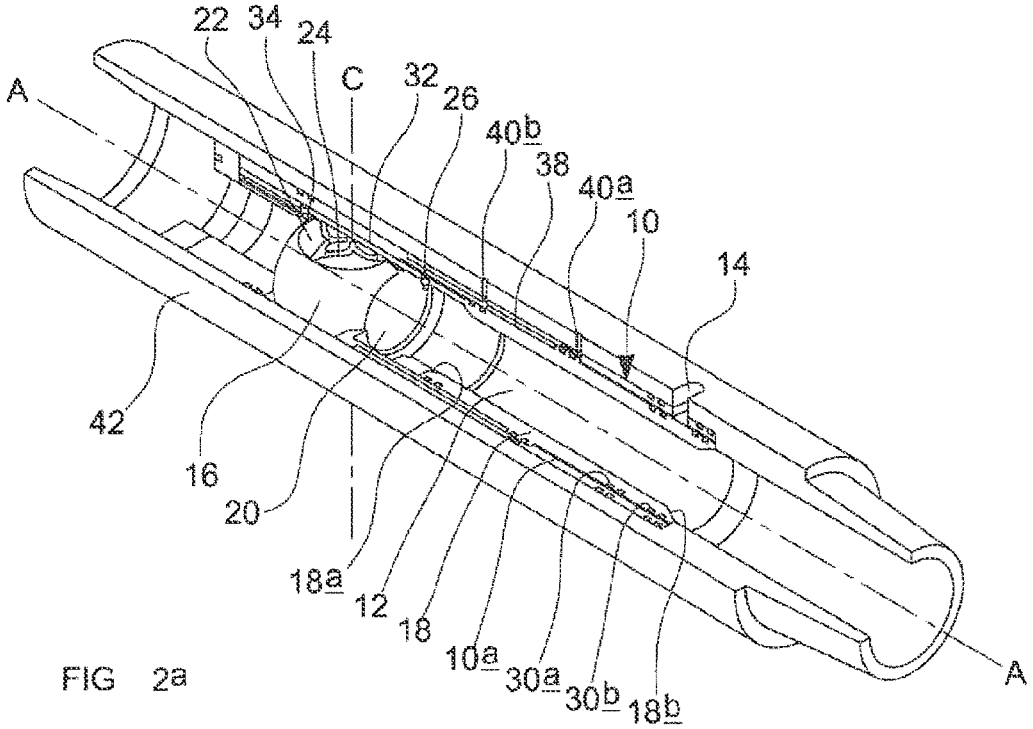
FIG. 2 is an alternative cutaway perspective view of a valve assembly according to the invention with a) the main valve member in its fully open position and the actuator sleeve in its equilibrium position, b) the main valve member in a partially open position and the actuator sleeve in its third position, c) the main valve member in its fully closed position and the actuator sleeve in its second position, d) the main valve member in a partially open position and the actuator sleeve in its third position, e) the main valve member in its fully open position and the actuator sleeve in its equilibrium position.
Figure 2B:
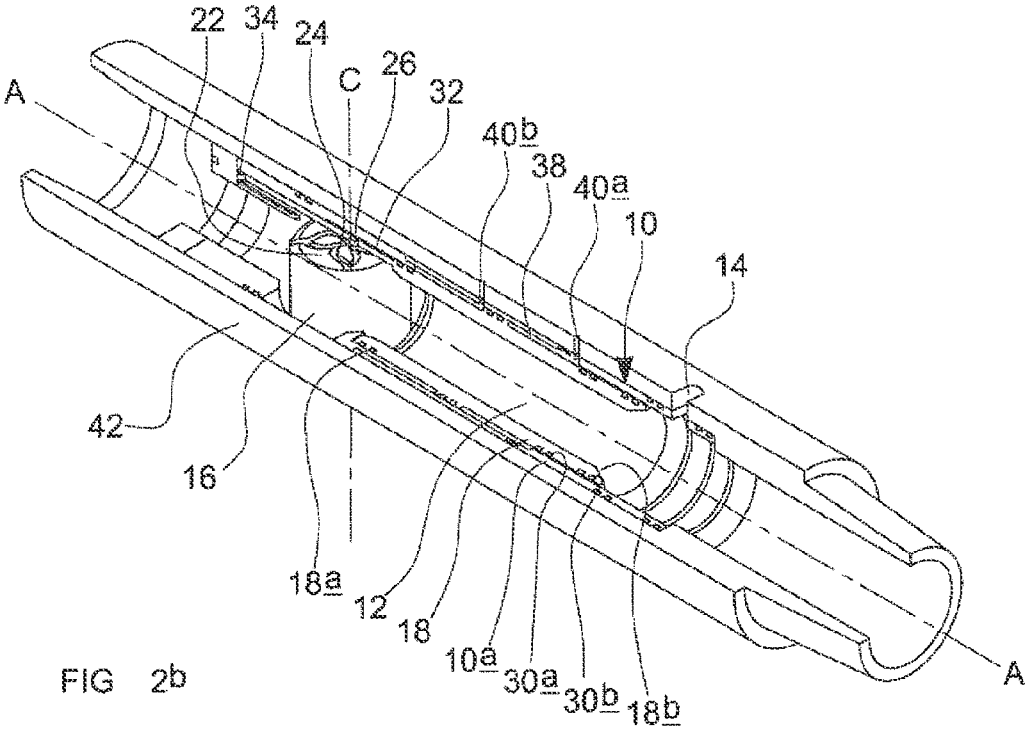
Figure 2C:
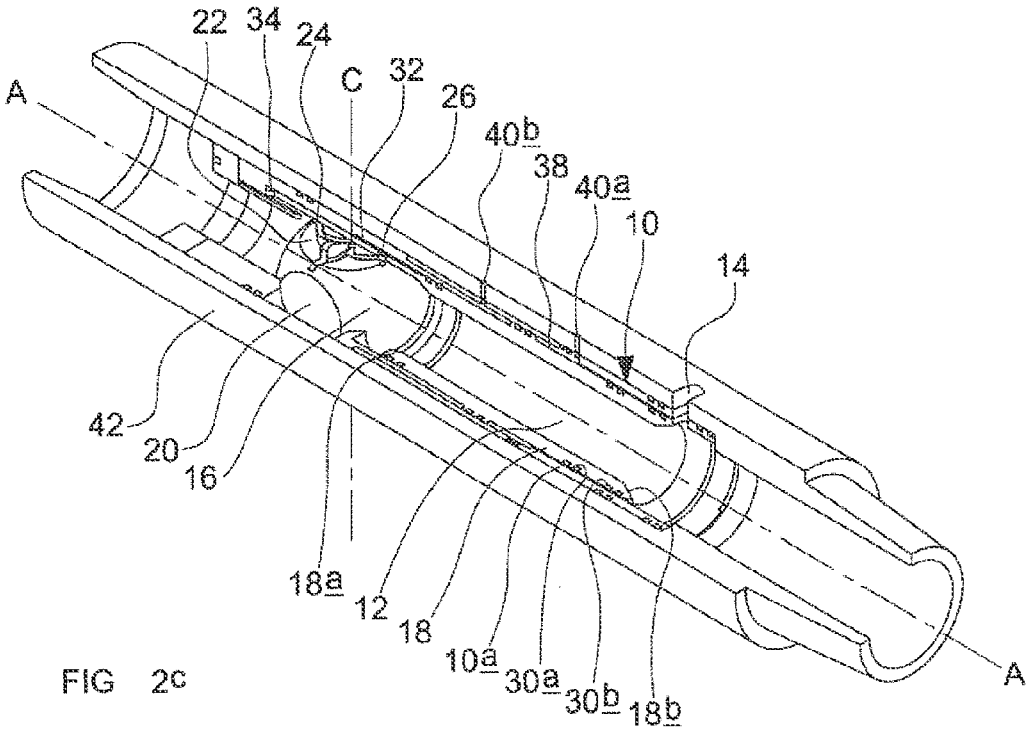
Figure 5D:
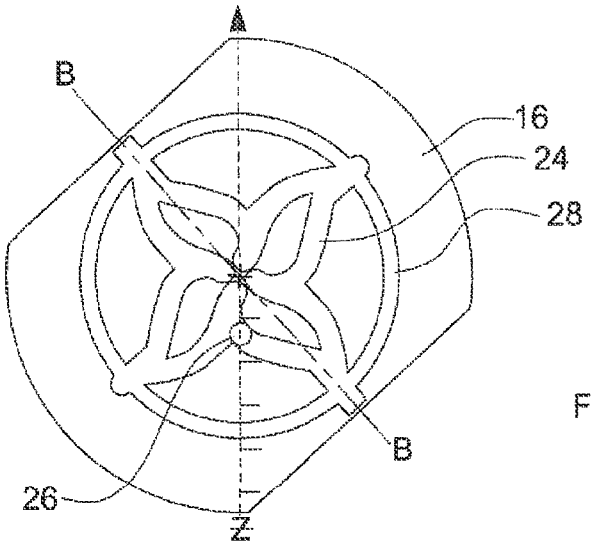
Figure 5E:
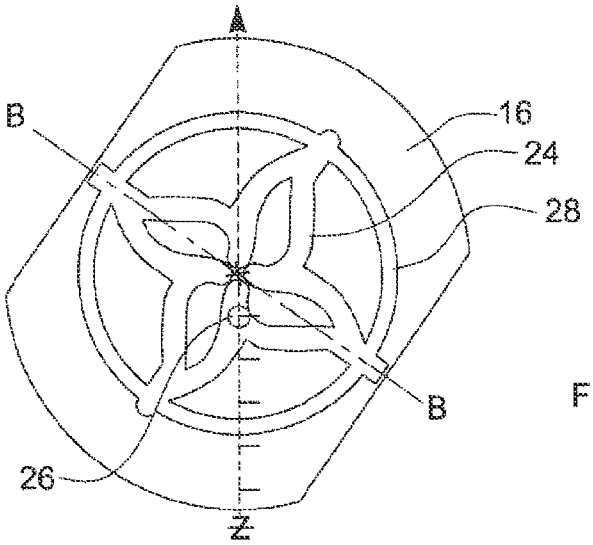
Figure 5F:
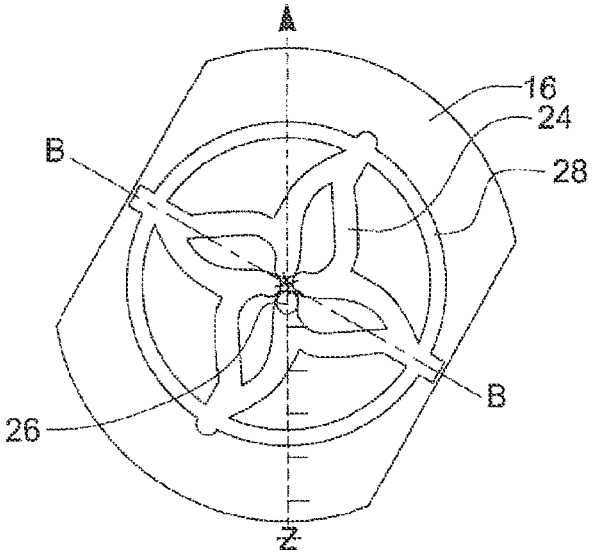

As the sliding movement of the actuator sleeve 18 continues the index pins 26 move into the third part of the first portion 24*a* of each track 24 (illustrated in FIGS. 5*d* and 5*e*), until further sliding movement of the actuator sleeve 18 towards the ball 16 is prevented by index pins 26 reaching the end of the third part of the first portion 24*a* of each track 24 (illustrated in FIGS. 1*b*, 2*b* and 5*f*). As this point, the actuator sleeve 18 is in its third position and the ball 16 is oriented such that the axis B is lying at 45° to the longitudinal axis A of the main passage 12. The ball 16 is thus in a partially open position in which the central passage 20 in the ball 16 is still in communication with the main passage 12, but the cross-sectional area available for flow into the central passage 20 of the ball 16 substantially reduced.

Figure 5G:
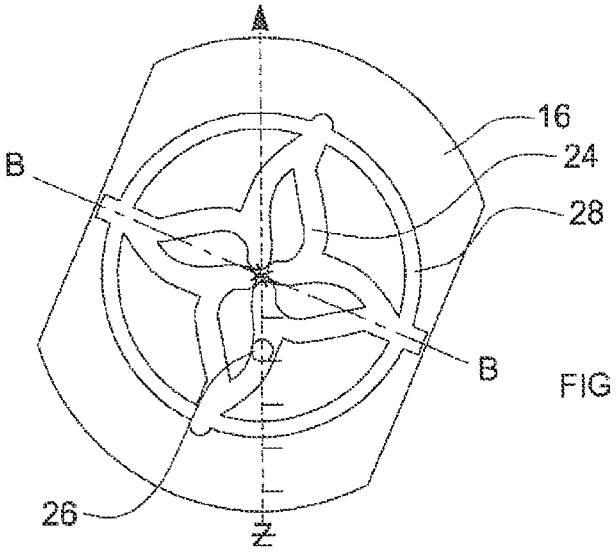
Figure 5H:
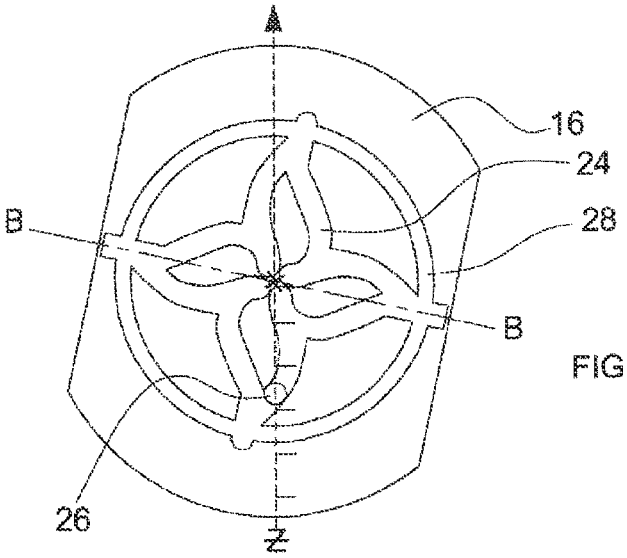
Figure 5I:
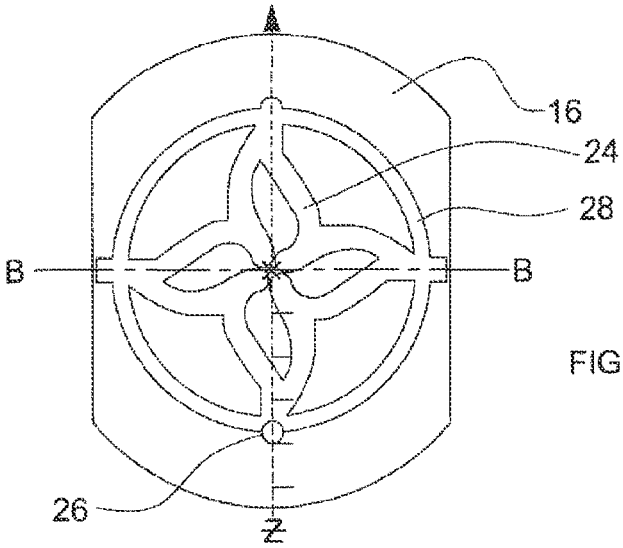

To continue rotation of the ball 16 to its fully closed position, the actuator sleeve 18 must then be moved in the opposition direction, away from the ball 16. Fluid pressure at the first hydraulic port 40*a* is released, and the port 40*a* exhausted. The actuator sleeve 18 may then move under the biasing force of the return spring 36 towards its equilibrium position. To assist this process, pressurised fluid is also supplied to the second hydraulic port 40*b*, so that the fluid pressure in the other half of the chamber 38 acts with the spring to push the actuator sleeve 18 back towards its equilibrium position. The index pins 26 enter the fourth part of the first portions 24*a* of the tracks 24 and as they move along the tracks 24, the ball 16 continues to rotate in the same direction as before (as illustrated in FIGS. 5*g* and 5*h*). Finally, the index pins 26 reach the end of the first portion 24*a* of each track 24 and at this point, the actuator sleeve is back in its second position, but this time the ball 16 is oriented with the axis B lying at 90° to the longitudinal axis A of the main passage 12 (illustrated in FIGS. 1*c*, 2*c*, and 5*i*). The ball 16 is thus in the fully closed position and the second hydraulic port 40*b* may now be vented to atmosphere.

As the end of the first part of the second portion 24*b* of the track 24 is closed, this time, engagement of the index pins 26 with the track 24 prevents the actuator sleeve 18 from returning to its equilibrium position. The ball 16 is thus locked in the fully closed position, and cannot be moved without the supply of pressurised fluid to the first actuation port 40*a*.

Figure 1D:
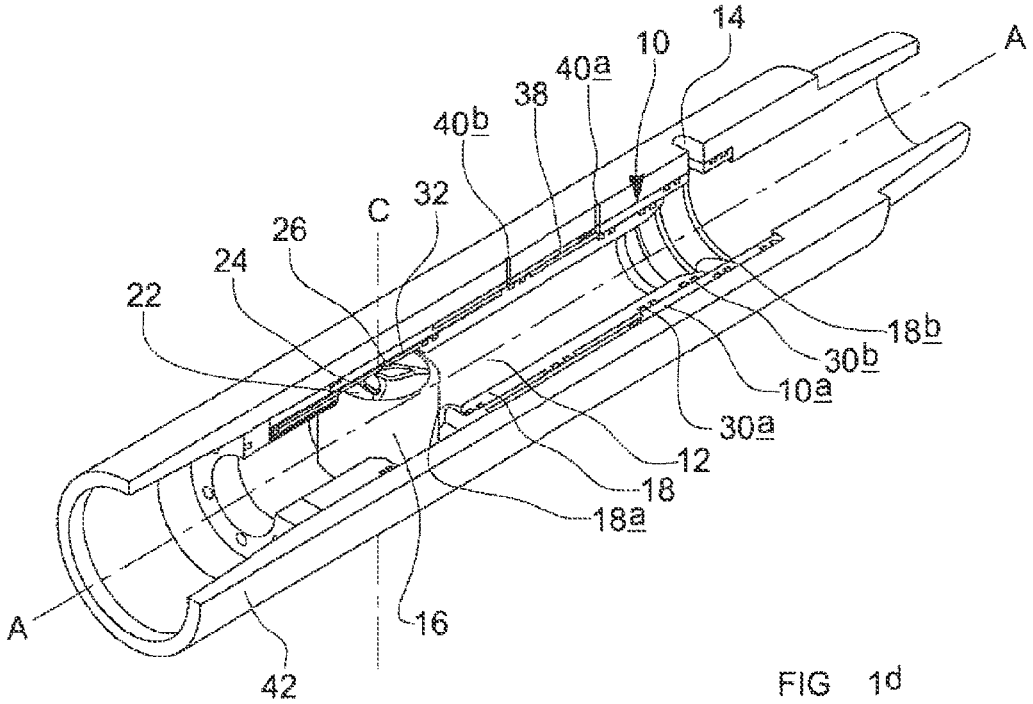
Figure 1E:
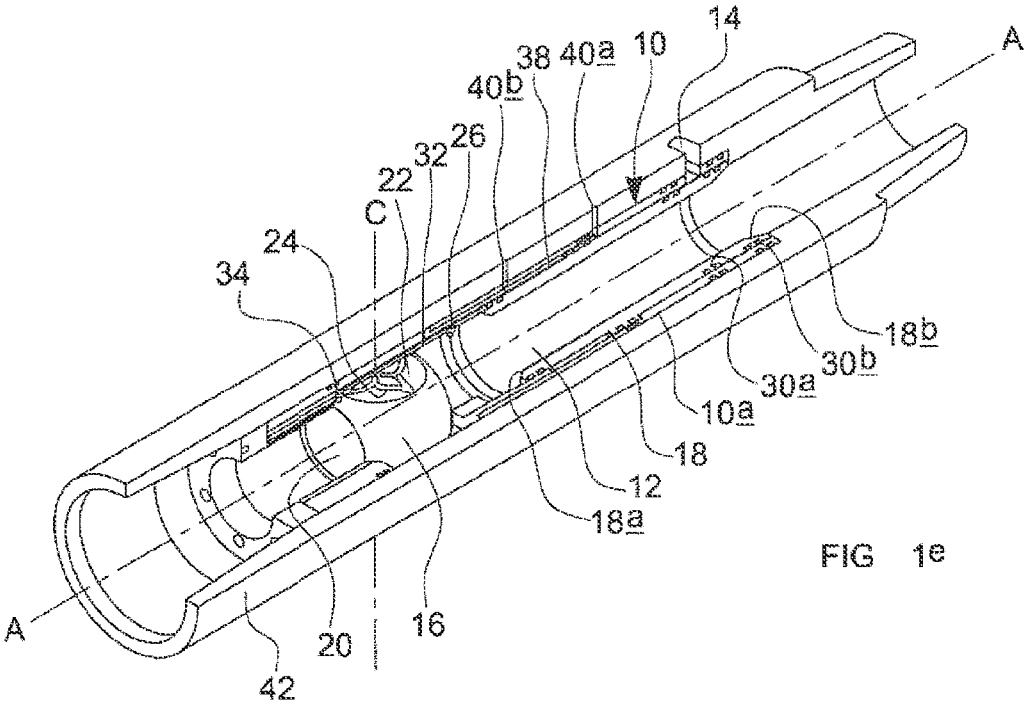
Figure 2D:
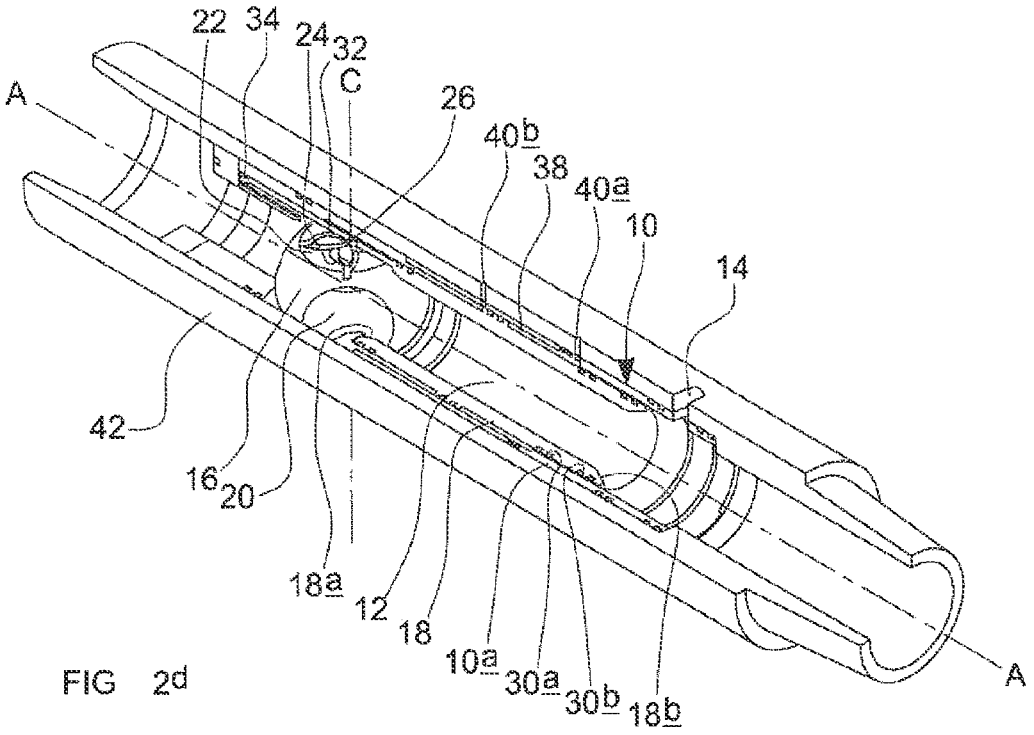
Figure 2E:
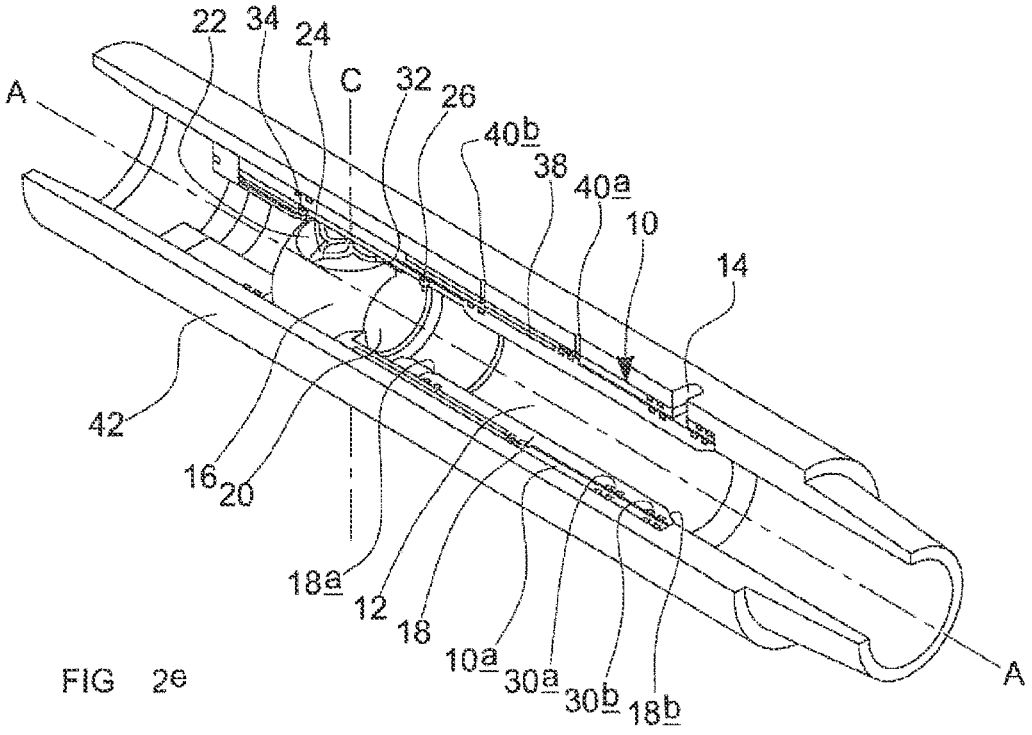

To return the ball 16 to its fully open position, pressurised fluid is once again supplied to actuation chamber 38 via the first port 40*a*. This pushes the actuator sleeve 18 from the second position towards the ball 16, to the third position, whilst the ball 16 rotates (as illustrated in FIGS. 1*d* and 2*d*). Pressure is then released from the first hydraulic port 40*a* and supplied to the second hydraulic port 40*b*, and the actuator sleeve 18 moves under the influence of the fluid pressure at the second hydraulic port 40*b* and the return spring 36 away Thorn the ball 16 and back to its second position (illustrated in FIGS. 1*e*, 2*e*.

During this process the movement of the index pins 26 in the tracks 24 and the rotation of the ball 16 described above is repeated in the second portion 24*b* of each track 24. This results in the ball 16 rotating through a further 45° when pressure is supplied to the first hydraulic port 40*a* and then through a further 45° to the fully open position when this pressure is released and pressurised fluid supplied to the second hydraulic port 40*b*.

This time, as the first part of the third portion 24*a* of each track 24 extends through the spherical surface of the ball 16, the index pins 26 are not caught in the tracks 24. The actuation sleeve 18 does not stay in its second position, as it can return to its equilibrium position with the index pin spaced from the ball 16 and the locking pin 34 located in the track 24 preventing further rotation of the ball 16. The second hydraulic port 40*b* may then be vented to atmosphere, and the force of the return spring 35 used to maintain the actuator sleeve 18 in this position.

In other words, rotation of the ball 16 through 90° is achieved through a cycle of supplying pressurised fluid to the first hydraulic port 40*a*, whilst the second 40*b* is vented to atmosphere, and then venting the pressure at the first hydraulic port 40*a* and supplying pressurised fluid to the second hydraulic port 40*b*. A further two repetitions of the cycle brings the ball 16 back into its original orientation. When the ball 16 is in the fully closed position, the actuator sleeve 18 is locked in its second position, whilst when the actuator sleeve 18 is in the fully open position, the actuator sleeve 18 can return to its equilibrium position.

Although the valve assembly described above could equally be used to control fluid flow along a tube without a side passage, as mentioned above, in this embodiment of the invention the body 10*a* of the valve assembly 10 is provided with a side passage 14 and the actuator sleeve 18 closes the side passage 14 when in its equilibrium position. The side passage 14 is, however, located towards a second end 18*b* of the actuator sleeve 18, so that when the actuator sleeve 18 moves towards the ball 16, the side passage 14 is uncovered. When the actuator sleeve 18 is in its second and third positions, flow of fluid through the side passage 14 is (in this example, entirely) unimpeded by the actuator sleeve 18. As a result, as the main valve 16 is closed, the side passage 14 is opened, and vice versa.

It should be appreciated that, as described above, when the main valve 16 is open, the actuator sleeve 18 moves from its equilibrium position to its second position without any rotation of the ball 16. This means that side passage 14 is opened whilst the main valve 16 is open. The ball 16 reaches its fully closed position when the actuator sleeve 18 returns to its second position from its third position, and the actuation sleeve 18 is then retained in the second position. As a result, the side passage 14 is held open whilst the main valve 16 is closed. When the main valve is opened, the position is reversed, and the side passage 14 is not closed until the main valve is fully open.

This aspect of this embodiment of the invention means that it is particularly suitable for use in a continuous drilling system, as it means that there is no possibility of both the main passage 12 and the side passage 14 being closed at the same time, so a continuous, and flow of mud down the drill string can be maintained. Moreover, closing the main passage 12 after the side passage 14 is opened, and closing the side passage 14 after the main passage 12 is opened ensures a smooth transfer of flow during the changeover from mud flow from the top of the drill pipe 42 to mud flow via the side passage 14, and reduces downhole pressure fluctuations.

When used in such an application, the body of the valve assembly 10 may be located in the main passage of a drill pipe 42 as in the accompanying figures. In this case, the side passage 14 in the valve assembly body 10*a* is aligned with a side passage in the drill pipe 42, two further passages are provided in the drill pipe to connect with the hydraulic ports 40*a*, 40*b*, and at least one seal is provided between the outer surface of the valve assembly body 10*a* and the interior surface of the drill pipe 42 to substantially prevent leakage of fluid along the drill pipe outside the valve assembly 10. Any conventional annular seal (elastomeric, metal-to-metal, O-ring, Chevron, Z, X etc) rated for the temperatures and pressures likely to be experienced in the drill pipe may be used. Preferably, however, this seal or seals is/are mounted on the exterior surface of the valve assembly body 10*a*, as this simplifies replacement of old or damaged seals.

A lock is provided above the valve assembly body 10*a* to prevent fluid pressure in the drill pipe 42 from ejecting the valve assembly 10 from the drill pipe 42. A preferred lock comprises a threaded retaining ring, but other types of lock—a bayonet ring, an indexed thread on the exterior surface of the valve assembly body 10*a*, or external through-bolts—may be used to lock the valve assembly 10 in place.

A valve assembly 10 according to the invention may, however, be integral with a drill pipe, the valve assembly body 10*a* thus being formed by the drill pipe itself. Equally, the valve assembly 10 may be mounted or integrally formed in a sub which has means (typically a screw thread) for connecting it between two adjacent pieces of drill pipe.

The invention is also advantageous when used in this application, as providing the index track 24 on the main valve member 16 itself makes this a particular compact construction. Integrating the auxiliary valve member with the actuator 18 for the main valve member 14 also assists in minimising the size of the valve assembly, and simplifies its construction and operation compared to similar prior art valve assemblies in which a separate actuation mechanism is required for both the main valve member and the side valve member.

The compactness of the valve assembly 10 is also assisted by the use of an oval side passage 14. Whilst the cross-section of the side passage 14 could be any shape, making it oval-shaped and arranging the side passage 14 with the major axis perpendicular to the longitudinal axis of the main passage 12 means that the axial distance the actuator sleeve 18 must travel to open completely the side passage 14 is reduced compared to a circular-section side passage of identical flow cross-sectional area.

Figure 6:
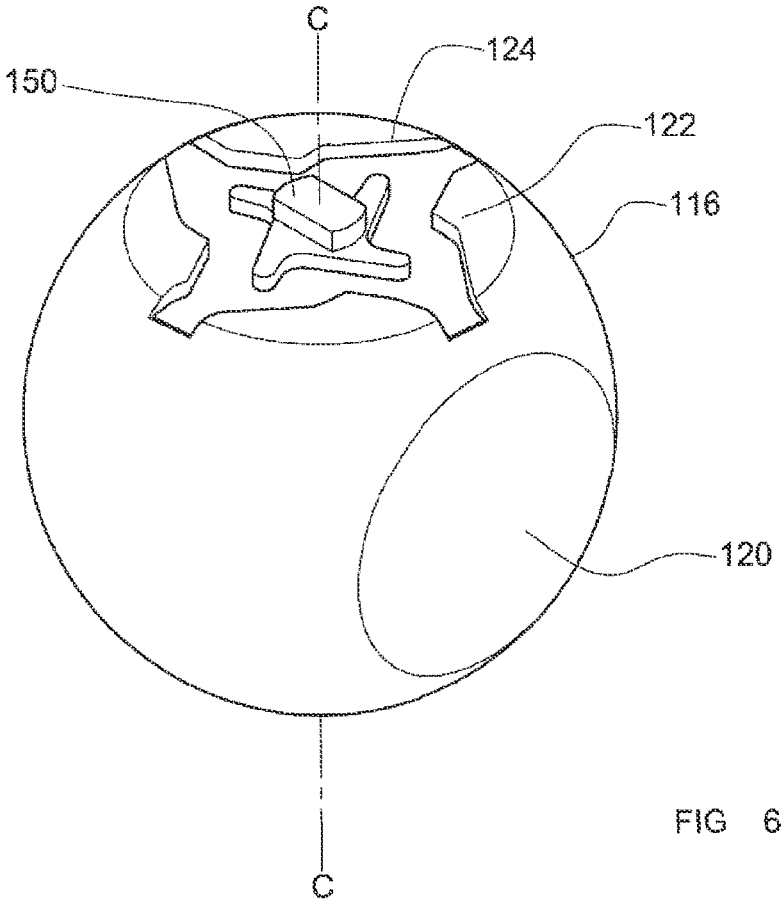
FIG. 6 is a perspective view of an alternative embodiment of main valve member for use in a valve assembly according to the invention.

An alternative embodiment of ball 116, suitable for use in a valve assembly according to the invention is illustrated in FIG. 6. As with the first embodiment of ball described above, this has a part spherical body with a central passage 120 which extends diametrically across the generally spherical body, and two diametrically opposed circular planar index surfaces 122. Both index surfaces 122 are parallel to one another and to a longitudinal axis of the central passage 120. The ball 116 is designed to be mounted within the main passage 12 of the valve assembly body 10*a* for rotation about axis C in just the same way as the first embodiment of ball 16 described above.

Again each index surface is provided with a track 124, which, again is a specially shaped groove in the index surface 22. As before, the index pins 26 of the actuator sleeve 18 engage with the tracks 124 to guide rotational movement of the ball 116 relative to the actuator sleeve 18 in a predetermined manner. The track 124 is also shaped so that, when the index pin 26 is located in the track 24, sliding movement of the actuator sleeve 18 relative to the valve assembly body 10*a* causes the ball 16 to rotate about its axis C.

Figure 7:
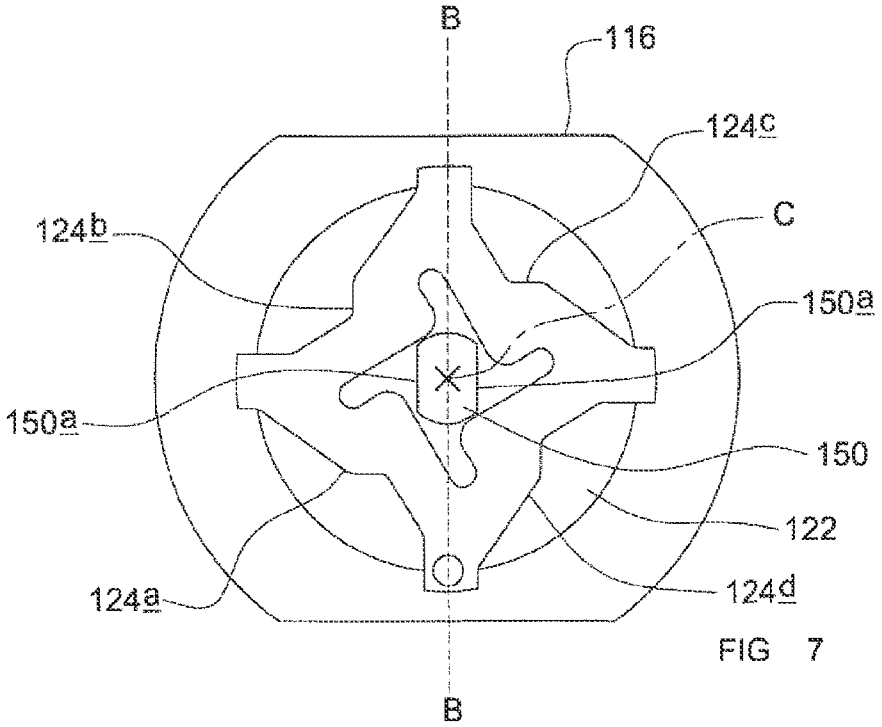
FIG. 7 is a plan view of the index surface of the main valve member shown in FIG. 6.

This embodiment of ball 116 differs from the first embodiment 16 in the exact configuration of the track 124, as best illustrated in FIG. 7. Broadly speaking, the tracks 24, 124 are very similar—both have four identical portions 24*a*, 124*a*, 24*b*, 124*b*, 24*c*, 124*c*, 24*d*, 124*d*, and each of the portions 24*a*, 124*a*, 24*b*, 124*b*, 24*c*, 124*c* 24*d*, 124*d* has a first part which extends radially inwardly toward the centre of the index surface 22, 122 before turning away from the centre of the index surface 22, 122, in this example to the left when the track 24 is viewed from above the ball 16, 116 and through about 45°, into a second part which continues in this direction before reaching a third part.

The first part of each portion 24*a*, 24*b*, 24*c*, 24*d* starts at an edge of the index surface 22 (the edge being the line of intersection between the index surface 22 and the spherical surface of the ball 16). Again, the first part of the first portion 124*a* and the first part of the third portion 124*c* of the track 124 are both located on a plane which includes the longitudinal axis B of the central passage 120 in the ball 116 and the axis of rotation C as best illustrated in FIG. 7.

However, in the alternative embodiment of ball 116, the third part turns through about a further 45°, again to the left when the track 124 is viewed from above the ball 116, before joining a fourth part which extends to the first part of the second portion 124*b* of track 124.

As in the first embodiment of ball described above, the fourth part of the first portion 124*a* is joined to the first part of the second portion 124*b*, the fourth part of the second portion 124*b* is joined to the first part of the third portion 124*c*, fourth part of the third portion 124*c* is joined to the first part of the fourth portion 124*d*, and the fourth part of the fourth portion 124*d* is joined to the first part of the first portion 124*a*.

The track 124 in this embodiment of ball 116 is significantly wider relative to the index pin 126 that the track in the first embodiment of ball 16, and so the index pin 26 only ever engages with one side of the track 124 at once during the rotation of the ball 116. This means that the actuating mechanism may be more debris tolerant, i.e. less likely to seize up if any particulate matter becomes lodged in the track 124 during use.

Another point of difference between the two embodiments of track 24, 124, is that, in the second embodiment, The first parts of all of the first, second, third and fourth portions 124*a*, 124*b*, 124*c*, 124*d* extend through the spherical surface of the ball 16 so that a pin in each of the first parts of the track 124 can be removed from the track 124 by a relative sliding movement without the need to move the pin perpendicular to the index surface 122.

The index surface 122 of the second embodiment of ball 116 is not provided with a pivot support formation, so that, when this embodiment of ball 116 is used, it is not necessary to provide the interior surface of the valve assembly body 10*a* with a corresponding formation for providing a pivot for rotation of the ball 116 about its axis C. This embodiment of ball 116 is therefore designed to float in the valve assembly body 10*a* without any form of pivot support. It will be appreciated, however, that in practice, it is desirable to ensure that the tolerances in the valve assembly 10 are sufficiently tight that there is very little capacity for movement of the ball 116 relative to the valve assembly body 10*a*, other than the desired rotational movement, of course.

The second embodiment of ball 116 is used in the valve assembly 10 in much the same way as the first, by supplying pressurised fluid to the first actuation port 40*a*, and the stages movement of the ball 116 with the index pin 26 is illustrated in FIGS. 8*a*-8*f*.

Figure 8A:
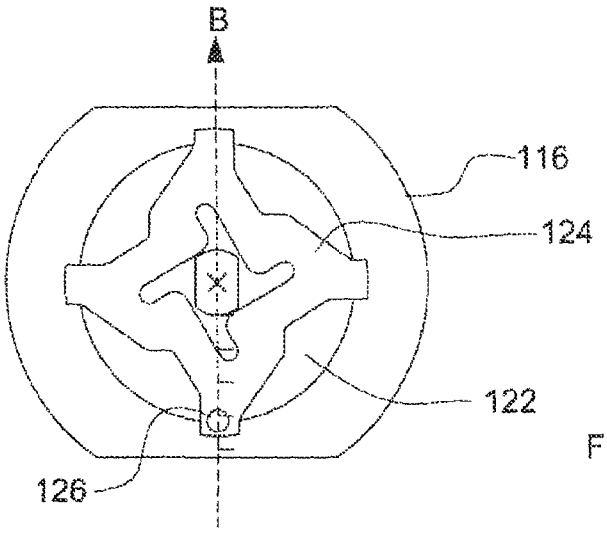
FIG. 8 is a top view of the main valve member shown in FIGS. 6 and 7 along with the index pin with a) the index pin in the first part of the first portion of the track, b) the index pin in the second part of the first portion of the track, c) the index pin at the end of the second part of the first portion of the track, d) the index pin in the third part of the first portion of the track, e) the index pin in the fourth part of the first portion of the track, and f) the index pin in the first part of the second portion of the track, with line Z showing the direction of travel of the index pin.
Figure 8B:
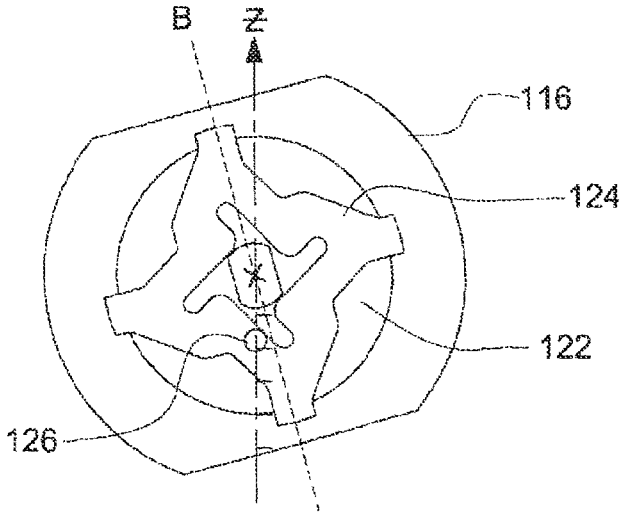
Figure 8C:
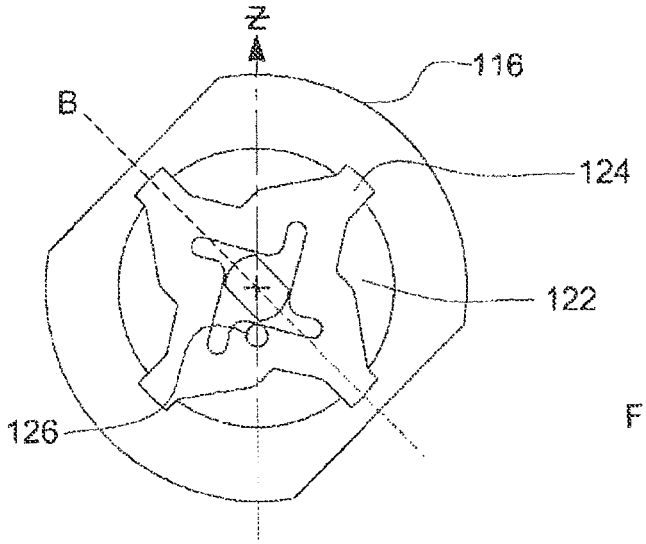

The pressurised fluid pushes the actuator sleeve 18 against the biasing force of the return spring 36 from its equilibrium position towards the ball 116 so that the index pins 26 enter into the first part of the first portion 124*a* of the track 124. The actuator sleeve 18 is then in its second position, illustrated in FIG. 8*a*. The interaction of the index pins 26 with the track 124 means that further sliding movement of the actuator sleeve 18 towards the ball 116 causes the ball 116 to rotate as the index pins 26 enter the second part of the first portion 124*a* of each track 124 (as illustrated in FIG. 8*b*).

As the sliding movement of the actuator sleeve 18 continues the index pins 26 move into the third part of the first portion 124*a* of each track 124 (illustrated in FIG. 8*c*), until further sliding movement of the actuator sleeve 18 towards the ball 16 is prevented by index pins 26 reaching the end of the third part of the first portion 24*a* of each track 24. As this point, the actuator sleeve 18 is in its third position and the ball 116 is oriented such that the axis B is lying at 45° to the longitudinal axis A of the main passage 12.

Figure 8D:
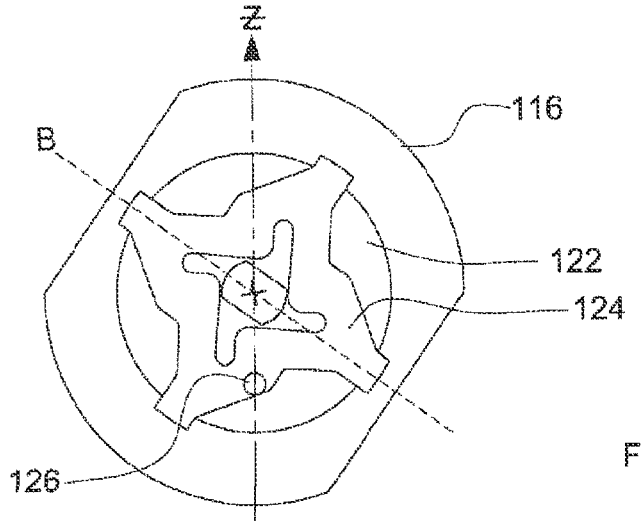
Figure 8E:
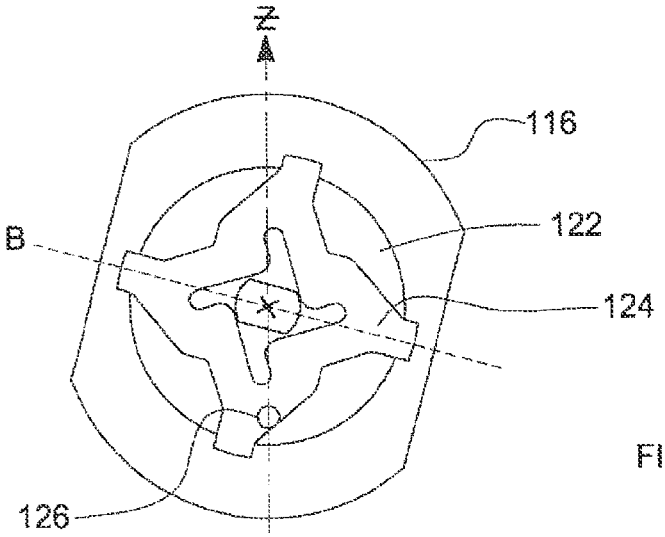

To continue rotation of the ball 116 to its fully closed position, the actuator sleeve 18 must then be moved in the opposition direction, away from the ball 116. Fluid pressure at the first hydraulic port 40*a* is released, and the port 40*a* exhausted. The actuator sleeve 18 may then move under the biasing force of the return spring 36 towards its equilibrium position. To assist this process, pressurised fluid is also supplied to the second hydraulic port 40*b*, so that the fluid pressure in the other half of the chamber 38 acts with the spring to push the actuator sleeve 18 back towards its equilibrium position. The index pins 26 enter the fourth part of the first portions 124*a* of the tracks 124 and as they move along the tracks 124, the ball 116 continues to rotate in the same direction as before (as illustrated in FIGS. 8*d* and 8*e*). Finally, the index pins 26 reach the end of the first portion 124*a* of each track 124 and at this point, the actuator sleeve 18 is back in its second position, but this time the ball 116 is oriented with the axis B lying at 90° to the longitudinal axis A of the main passage 12 (illustrated in FIG. 8*f*). The ball 116 is thus in the fully closed position and the second hydraulic port 40*b* may now be vented to atmosphere.

The ball 16 is returned to its fully open position in exactly the same way as in relation to the first embodiment of ball 16 described above. During this process the movement of the index pins 26 in the tracks 124 and the rotation of the ball 116 described above is repeated in the second portion 124*b* of each track 124. This results in the ball 116 rotating through a further 45° when pressure is supplied to the first hydraulic port 40*a* and then through a further 45° to the fully open position when this pressure is released and pressurised fluid supplied to the second hydraulic port 40*b*.

The actuation sleeve 18 returns to its equilibrium position with the index pin spaced from the ball 116 and the locking pin 34 located in the track 24 preventing further rotation of the ball 116. The second hydraulic port 40*b* may then be vented to atmosphere, and the force of the return spring 35 used to maintain the actuator sleeve 18 in this position.

A further two repetitions of the cycle brings the ball 116 back into its original orientation. When the ball 16 is in the fully closed position, the actuator sleeve 18 is locked in its second position, whilst when the actuator sleeve 18 is in the fully open position, the actuator sleeve 18 can return to its equilibrium position.

In the first embodiment of ball 16, the end of the first parts of the second portion 24*b* and fourth portion 24*d* of the track 24 are closed, so engagement of the index pins 26 with the track 24 prevents the actuator sleeve 18 from returning to its equilibrium position. The ball 16 is thus locked in the fully closed position, and cannot be moved without the supply of pressurised fluid to the first actuation port 40*a*. This is not the case in the second embodiment of ball 116, as mentioned above.

To achieve such locking, the second embodiment of ball 116 may be provided with a nub 150 which extends from the centre of the index surface 122. When viewed in plan view, as in FIG. 7, the nub 150 is generally rectangular, having two generally parallel long sides 150*a*, which are joined by two short sides 150*b*. The long sides 150*a* lie generally parallel to the axis B. In this example, the short sides 150*b* are curved outwardly relative to one another.

For the nub 150 be useful and effective, a different configuration of actuator arms is required, and an embodiment of suitable actuator arm 132 is illustrated in FIGS. 9*a*-9*f*. In this embodiment, the actuator arm 132 carries an index pin 126, but no locking pin. The actuator arm 132 is bifurcated, having two parts separated by a longitudinally extending gap, the width of the gap, i.e. the separation of the two parts, varying along the length of the actuator arm 132. As a result, the actuator arm 132 has a first portion 132*a* which is distal to the actuator sleeve 18 and which has a narrow longitudinal gap, a second portion 132*b* which has a wide longitudinal gap, and a third portion 132*c* which is adjacent the actuator sleeve 18 and which has no gap, but which carries the index pin 126.

The width of the narrow longitudinal gap is just slightly greater than the separation of the long sides 150*a* of the nub 150, whilst the width of the wide longitudinal gap is just greater than the separation of the short sides 150*b* of the nub 150. The nub 150 extends into the gap, and moves along the gap, as illustrated in FIGS. 9*a*-9*f*, during rotation of the ball 116.

Figure 9A:
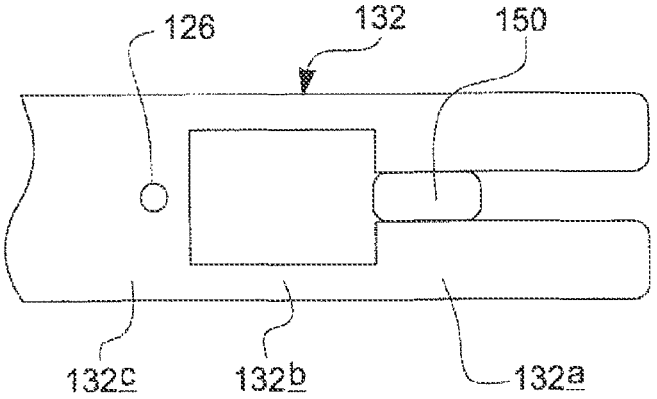
FIG. 9 is a top view of the actuator arm, index pin and nub of the main valve member shown in FIGS. 6 and 7, in a) the position corresponding to FIG. 8*a* when the main valve member is in its open position, b) the position corresponding to FIG. 8*c* when the main valve member has rotated through about 45°, c) the position corresponding to FIG. 8*f* when the main valve member is the closed position d) when the main valve member is rotated through a further 45°, e) when the main valve member is returned to its open position, and f) when the actuator sleeve is in its equilibrium position.
Figure 9B:
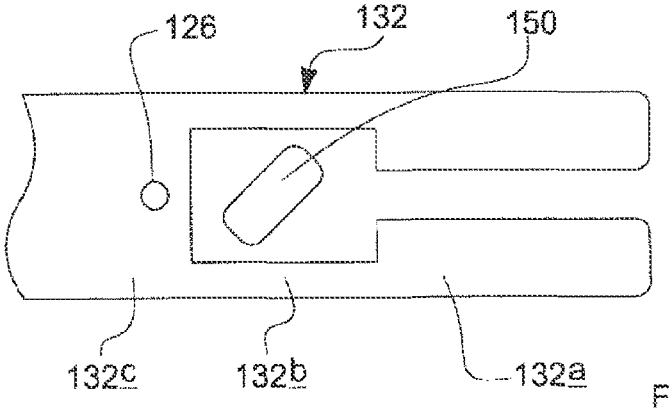

As the index pins 126 enter into the first part of the first portion 124*a* of the track 124, the nub 150 moves along the narrow longitudinal gap, as illustrated in FIG. 9*a*. The actuator sleeve 18 is then in its second position, illustrated in FIG. 8*a*. As the width of the narrow longitudinal gap is just slightly greater than the separation of the long sides 150*a* of the nub 150, the engagement of the nub 150 with the actuator arm 132 prevents rotation of the ball 116. With further sliding movement of the actuator sleeve 18 towards the ball 116, the nub 150 enters the wide longitudinal gap, thus allowing the ball 116 to rotate as the index pins 126 enter the second part of the first portion 124*a* of each track 124 (as illustrated in FIG. 8*b* and FIG. 9*b*).

As the sliding movement of the actuator sleeve 18 towards the ball 116 continues, the nub 150 travels along the wide longitudinal gap towards the third portion 132*c* of the actuator arm, with its long sides 150*a* at an angle of between 0 and 45° to the longitudinal axis of the gap.

Figure 8F:
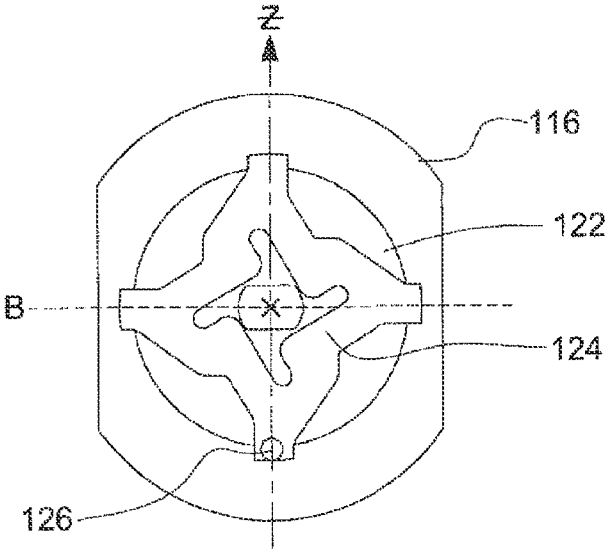
Figure 9C:
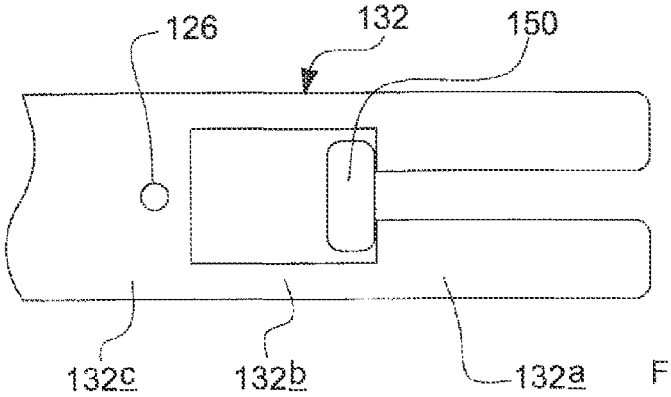

When the actuator sleeve 18 is moved in the opposition direction, away from the ball 116, the nub 150 travels back along the wide longitudinal gap towards the narrow longitudinal gap, until, when the actuator sleeve 18 is back in its second position, and the ball 116 is oriented with the axis B lying at 90° to the longitudinal axis A of the main passage 12 (illustrated in FIG. 8*f*). At this point, the long sides 150*a* of the nub 150*a* extend generally perpendicular of the longitudinal axis of the gap, as illustrated in FIG. 9*c*. As the long sides 150*a* of the nub 150 are significantly longer than the width of the narrow longitudinal gap, it will be appreciated that movement of the nub 150 into the narrow longitudinal gap cannot occur without further rotation of the ball 116. As a result, engagement of the nub 150 with the actuator arm 132 prevents the actuator sleeve 18 from returning to its equilibrium position.

Figure 9D:
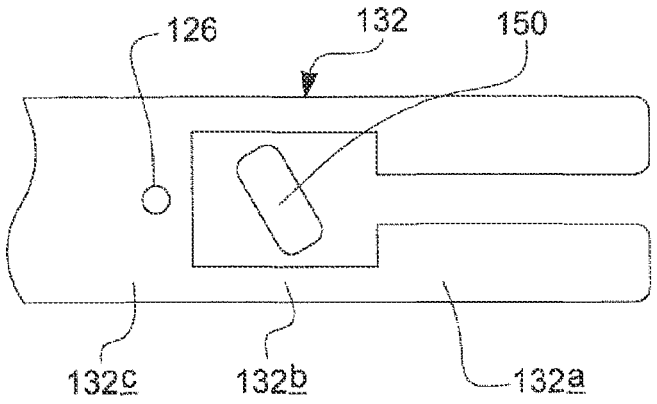
Figure 9E:
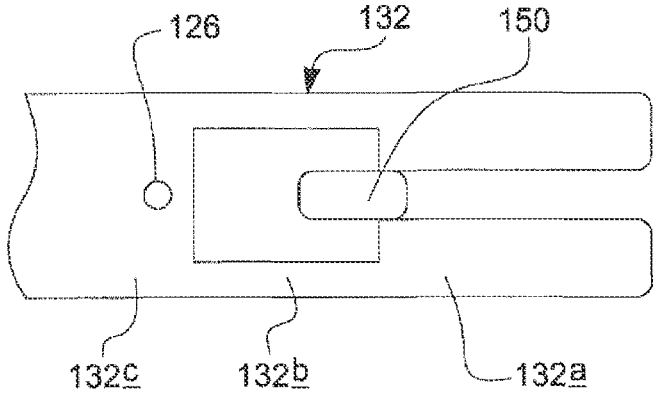
Figure 9F:
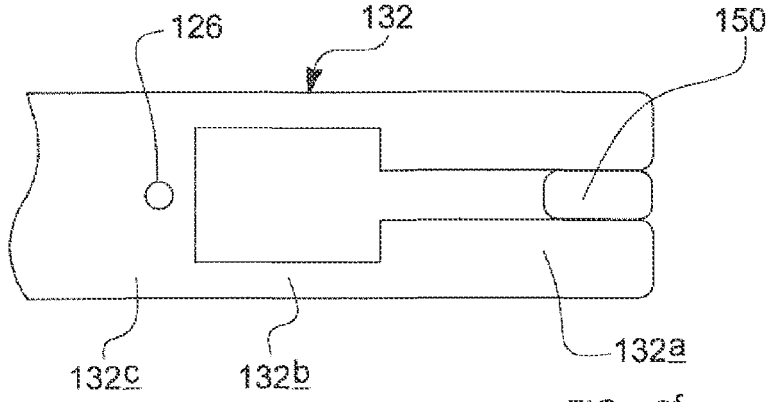

As the ball 116 is returned to its fully open position, the nub 150 moves along the wide longitudinal gap towards to the actuator sleeve 18 (as illustrated in FIG. 9*d*), and then along the wide longitudinal gap towards the narrow longitudinal gap. During this process, the nub 150 is rotated through 90°, so that when it reaches the narrow longitudinal gap, it can pass into the narrow longitudinal gap (as illustrated in FIG. 9*e*), and the actuator sleeve 18 can return to its equilibrium position.

When the actuator sleeve 18 returns to its equilibrium position, the nub 150 remains in the narrow longitudinal gap, thus preventing rotation of the ball 116 without accompanying sliding movement of the actuator sleeve 18.

R should be appreciated that two embodiments of the invention have been described above by way of example only. Various modifications may be made within the scope of the invention. For example, the index track 24 need not be a groove in the index surface 22—any arrangement which couples the coupling part and the track 24 so that the coupling part can move along but not significantly away from the track during sliding of the actuator arms 32 relative to the index surface 22 could be used. It could, for example, be a ridge, and the coupling part on the actuator arms 32 comprising two pins which, as the coupling part engages with the track 24 lie one either side of the track 24.

Whilst in this example, the return spring 36 is a helical compression spring, any other suitable spring may be used instead. Examples of suitable types of spring include disc springs, leaf springs, an elastomeric element, or a pressurised fluid reservoir.

Whilst in this embodiment of the invention only one side passage 14 is provided, there could be more than one. Similarly, whilst in this embodiment of the invention, the side passage 14 is opened by the second end 18*a* of the actuator sleeve 18 uncovers the side passage 14, it would equally be possible to provide apertures in the actuator sleeve 18 which, when the actuator sleeve is in the second position line up with the side passage 14 to allow flow of flow into the main passage 12 via the side passage 14.

It should be appreciated that, although in this example, the main valve member 16 is a ball valve, this need not be the case. The main valve member 16 could, for example, be cylindrical, with the track 24 or tracks 24 being provided on one of or the circular end surface.

In this embodiment of the invention, the use of two diametrically opposite actuator arms 32 and tracks 24 is described. It will be appreciated, however, that whilst this is may be a preferred arrangement for even distribution of forces over the ball 16 and for minimising the forces experienced by each actuator arm 32 and coupling part 26, only one is required to actuate the main valve 16.

It will be appreciated that it is not necessary to provide the return spring 36, as the double acting piston formed by the actuator sleeve 18 and the hydraulic chamber 38 mean that movement of the actuator sleeve 18 back to its equilibrium position can be achieved by the supply of pressurised fluid to the second hydraulic port 40*b*.

Similarly, the provision of the two actuator ports 40*a*, 40*b* is not absolutely necessary for the actuation of the ball valve 16 as described above, since the return spring 36 could be solely responsible for moving the actuator sleeve 18 back from its third and second positions. It is, however, advantageous to provide two counterbalanced ports as, otherwise, it would be necessary to make the return spring 36 sufficiently strong to ensure that the actuator sleeve 18 does not move if a positive differential pressure between the main passage 12 of the valve assembly 10 and the exterior of the valve assembly 10. A high spring force demands a high actuator pressure to open the main valve member 16 and this can increase the cost and complexity of the equipment required for supplying the pressurised fluid to the hydraulic port 40*a*. The use of two hydraulic ports 40*a*, 40*b* reduces the required spring force, and also means that these ports 40*a*, 40*b* need not be sealed after use and before the valve assembly moves down into a well bore. If the exterior of the valve assembly is subjected to an external fluid pressure, the two ports 40*a* and 40*b* will be exposed to the same pressure, and the resulting forces on the actuator sleeve will balance. There cannot, therefore, be any net force acting on the actuator sleeve 18, and therefore the main valve 16 will not be moved. In contrast, if only one port 40*a* were provided, it would be necessary to seal this port 40*a* after use, since any external fluid pressure sufficient to overcome the biasing force of the return spring 36 would actuator the main valve 16.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A valve assembly comprising a body having a main passage, and a valve member which is located in the main passage and which is rotatable between an open position in which the main passage is substantially open, and a closed position in which the valve member substantially blocks the main passage, and an actuator which is movable generally parallel to the longitudinal axis of the main passage, the actuator being engaged with the valve member such that movement of the actuator generally parallel to the longitudinal axis of the main passage causes the valve member to rotate between its open and closed positions, wherein, the valve member is provided with a central passage which extends right through the valve member, the central passage having a longitudinal axis which extends generally perpendicular to the axis of rotation of the valve member, when the valve member is in the open position, the central passage lies generally parallel to the main passage so that fluid flowing along the main passage of the valve assembly travels via the central passage in the valve member, and when the valve member is in the closed position, the central passage lies generally perpendicular to the main passage, the valve member is provided with a generally circular and planar index surface which extends generally parallel to the longitudinal axis of the central passage, the index surface is provided with a track and the actuator sleeve is provided with a corresponding coupling formation which engages with the track to guide movement of the ball relative to the actuator in a predetermined manner, and the coupling formation comprises a pin mounted on an arm which extends between the index surface and the body from an end of the actuator adjacent the valve member, the pin extending from the arm towards the index surface.

2. A valve assembly according to claim 1 wherein the body is further provided with a side passage, the side passage extending from the main passage to the exterior of the body.

3. A valve assembly according to claim 2 wherein the side passage extends generally at right angles to the longitudinal axis of the main passage.

4. A valve assembly according to claim 1 wherein the body is selected from a group consisting of a drill pipe and pump in sub for connection to a drill pipe.

5. A valve assembly according to claim 2 wherein the actuator is movable, generally parallel to the longitudinal axis of the passage, between an open position in which the side port is open, and a closed position in which the actuator substantially closes the side port.

6. A valve assembly according to claim 5 wherein when the actuator is in the open position, the valve member is in the closed position, and when the actuator is in the closed position, the valve member is in the open position.

7. A valve assembly according to claim 1 wherein the actuator is located within the main passage.

8. A valve assembly according to claim 1 wherein the actuator comprises a generally cylindrical sleeve.

9. A valve assembly according to claim 1 wherein the valve member and actuator are engaged such that movement of the actuator generally parallel to the longitudinal axis of the main passage in a first direction causes the valve member to rotate through a first angle in a first rotational sense and subsequent movement of the actuator generally parallel to the longitudinal axis of the main passage in a second, opposite, direction causes the valve member to rotate through a second angle in the first rotational sense, the sum of the first and second angles being about 90°.

10. A valve assembly according to claim 9 wherein the first and second angles are about 45°.

11. A valve assembly according to claim 1 wherein the track is shaped such that, by engagement of the coupling formation with the track, sliding movement of the actuator relative to the body causes the ball to rotate.

12. A valve assembly according to claim 1 wherein the track comprises a groove in the index surface.

13. A valve assembly according to claim 1 wherein the track forms a continuous loop around the index surface.

14. A valve assembly according to claim 13 wherein the track comprises four substantially identical portions each of which extends from an edge of the index surface towards the centre of the index surface and then back towards the edge of the index surface.

15. A valve assembly according to claim 1 wherein the body is provided with an actuator conduit and the actuator configured such that the movement of the actuator generally parallel to the longitudinal axis of the main passage in one direction is achieved by the supply of pressurised fluid to the actuator conduit.

16. A valve assembly according to claim 15 wherein the body is provided with a further actuator conduit and the actuator configured such that the movement of the actuator generally parallel to the longitudinal axis of the main passage in an opposite direction is achieved by the supply of pressurised fluid to the further actuator conduit.

17. A valve assembly according to claim 15 wherein the valve assembly further comprises a return spring which urges the actuator to move generally parallel to the longitudinal axis of the main passage in the opposite direction.

18. A valve assembly according to claim 1 wherein there is an actuation chamber between the actuator and the body of the valve assembly, the chamber being divided into two by a seal which extends between the body of the valve assembly and the actuator to substantially prevent flow of fluid between the two parts of the actuation chamber, and two ports are provided through the body, the first port extending from the exterior of the body into the first part of the actuation chamber, and the second port extending from the exterior of the body into the second part of the actuation chamber.

19. A valve assembly comprising a body having a main passage, and a valve member which is located in the main passage and which is rotatable between an open position in which the main passage is substantially open, and a closed position in which the valve member substantially blocks the main passage, and an actuator which is movable generally parallel to the longitudinal axis of the main passage, the actuator being engaged with the valve member such that movement of the actuator generally parallel to the longitudinal axis of the main passage causes the valve member to rotate between its open and closed positions wherein, the valve member is provided with a central passage which extends right through the valve member, the central passage having a longitudinal axis which extends generally perpendicular to the axis of rotation of the valve member, when the valve member is in the open position, the central passage lies generally parallel to the main passage so that fluid flowing along the main passage of the valve assembly travels via the central passage in the valve member, and when the valve member is in the closed position, the central passage lies generally perpendicular to the main passage, the valve member is provided with a generally circular and planar index surface which extends generally parallel to the longitudinal axis of the central passage, the index surface is provided with a track and the actuator sleeve is provided with a corresponding coupling formation which engages with the track to guide movement of the ball relative to the actuator in a predetermined manner, and the track forms a continuous loop around the index surface.

20. A valve assembly according to claim 19 wherein the track comprises four substantially identical portions each of which extends from an edge of the index surface towards the centre of the index surface and then back towards the edge of the index surface.

* * * * *